US011022106B2

(12) United States Patent
Hines et al.

(10) Patent No.: US 11,022,106 B2
(45) Date of Patent: Jun. 1, 2021

(54) HIGH-PRESSURE POSITIVE DISPLACEMENT PLUNGER PUMP

(71) Applicant: Graco Minnesota Inc., Minneapolis, MN (US)

(72) Inventors: Bradley H. Hines, Andover, MN (US); Brian W. Koehn, Minneapolis, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 35 days.

(21) Appl. No.: 16/242,497

(22) Filed: Jan. 8, 2019

(65) Prior Publication Data

US 2019/0211817 A1 Jul. 11, 2019

Related U.S. Application Data

(60) Provisional application No. 62/615,115, filed on Jan. 9, 2018.

(51) Int. Cl.
*F04B 9/02* (2006.01)
*F04B 17/03* (2006.01)
(Continued)

(52) U.S. Cl.
CPC ..... *F04B 9/02* (2013.01); *F04B 17/03* (2013.01); *F04B 27/005* (2013.01); *F04B 27/02* (2013.01); *F04B 35/01* (2013.01); *F04B 35/04* (2013.01)

(58) Field of Classification Search
CPC .. F04B 17/03; F04B 35/04; F04B 9/02; F04B 9/025; F04B 11/005; F04B 27/005; F04B 27/02; F04B 35/01; F04B 53/143
See application file for complete search history.

(56) References Cited

U.S. PATENT DOCUMENTS 1,650,377 A 11/1927 Nixon
2,407,792 A 9/1946 McMillan
(Continued)

FOREIGN PATENT DOCUMENTS

CN 102947593 A 2/2013
EP 0781922 A1 7/1997
(Continued)

OTHER PUBLICATIONS

Second Chinese Office Action for CN Application No. 201810016947.X, dated Mar. 29, 2019, pp. 7.
(Continued)

*Primary Examiner* — Bryan M Lettman
(74) *Attorney, Agent, or Firm* — Kinney & Lange, P.A.

(57) ABSTRACT

A drive system for a pump includes a housing defining an internal pressure chamber, a working fluid disposed within and charging the internal pressure chamber, and a reciprocating member disposed within the internal pressure chamber. A fluid displacement component has first and second surfaces. The first surface is configured to contact the working fluid and the second surface is configured to contact the process fluid. The area of the first surface is greater than the area of the second surface. A pull extends between and connects the reciprocating member and the fluid displacement component. The pull mechanically transfers a pulling force from the reciprocating member to the fluid displacement component.

16 Claims, 9 Drawing Sheets

(51) Int. Cl.

| | |
|---|---|
| ***F04B 35/04*** | (2006.01) |
| ***F04B 35/01*** | (2006.01) |
| ***F04B 27/02*** | (2006.01) |
| ***F04B 27/00*** | (2006.01) |

(56) References Cited

U.S. PATENT DOCUMENTS

| | | | | |
|---|---|---|---|---|
| 2,491,230 | A | 12/1949 | Theis | |
| 2,752,854 | A | 7/1956 | Prior et al. | |
| 3,075,468 | A | 1/1963 | Eifel | |
| 3,164,101 | A | 1/1965 | Van Nederynen | |
| 3,207,080 | A | 9/1965 | Schlosser | |
| 3,250,225 | A | 5/1966 | Taplin | |
| 3,276,389 | A | 10/1966 | Bower, Jr. | |
| 3,416,461 | A | 12/1968 | McFarland | |
| 3,542,491 | A | 11/1970 | Newman | |
| 3,652,187 | A | 3/1972 | Loeffler et al. | |
| 3,680,981 | A | 8/1972 | Wagner | |
| 3,741,689 | A | 6/1973 | Rupp | |
| 3,769,879 | A | 11/1973 | Lofquist, Jr. | |
| 3,775,030 | A | 11/1973 | Wanner | |
| 3,849,033 | A | 11/1974 | Schall | |
| 3,916,449 | A | 11/1975 | Davis | |
| 3,999,896 | A | 12/1976 | Sebastiani | |
| 4,008,984 | A | 2/1977 | Scholle | |
| 4,068,982 | A | 1/1978 | Quarve | |
| 4,123,204 | A | 10/1978 | Scholle | |
| 4,365,745 | A | 12/1982 | Beck | |
| 4,403,924 | A | 9/1983 | Gebauer et al. | |
| 4,459,089 | A | 7/1984 | Vincent et al. | |
| 4,549,467 | A | 10/1985 | Wilden et al. | |
| 4,615,259 | A * | 10/1986 | Anbe | F04B 27/02 417/26 |
| 4,778,356 | A | 10/1988 | Hicks | |
| 4,815,360 | A | 3/1989 | Winterle | |
| 4,883,412 | A | 11/1989 | Malizard et al. | |
| 4,902,206 | A | 2/1990 | Nakazawa et al. | |
| 5,066,199 | A | 11/1991 | Reese et al. | |
| 5,106,274 | A | 4/1992 | Holtzapple | |
| 5,145,339 | A | 9/1992 | Lehrke et al. | |
| 5,165,869 | A | 11/1992 | Reynolds | |
| 5,174,731 | A | 12/1992 | Korver | |
| 5,213,485 | A | 5/1993 | Wilden | |
| 5,219,274 | A | 6/1993 | Pawlowski et al. | |
| 5,249,932 | A | 10/1993 | Van Bork | |
| 5,257,914 | A | 11/1993 | Reynolds | |
| 5,279,504 | A | 1/1994 | Williams | |
| 5,362,212 | A | 11/1994 | Bowen et al. | |
| 5,378,122 | A | 1/1995 | Duncan | |
| 5,527,160 | A | 6/1996 | Kozumplik, Jr. et al. | |
| 5,567,118 | A | 10/1996 | Grgurich et al. | |
| 5,616,005 | A | 4/1997 | Whitehead | |
| 5,649,809 | A | 7/1997 | Stapelfeldt | |
| 5,816,778 | A | 10/1998 | Elsey, Jr. et al. | |
| 5,927,954 | A | 7/1999 | Kennedy et al. | |
| 6,036,445 | A | 3/2000 | Reynolds | |
| 6,106,246 | A | 8/2000 | Steck et al. | |
| 6,109,878 | A | 8/2000 | Barton et al. | |
| 6,142,749 | A | 11/2000 | Jack et al. | |
| 6,158,982 | A | 12/2000 | Kennedy et al. | |
| 6,280,149 | B1 | 8/2001 | Able et al. | |
| 6,299,415 | B1 | 10/2001 | Bahrton | |
| 6,402,486 | B1 | 6/2002 | Steck et al. | |
| 6,468,057 | B1 | 10/2002 | Beck | |
| 6,474,961 | B1 | 11/2002 | Timmer et al. | |
| 7,128,541 | B2 | 10/2006 | Kach | |
| 7,399,168 | B1 | 7/2008 | Eberwein | |
| 7,517,199 | B2 | 4/2009 | Reed et al. | |
| 7,600,985 | B2 | 10/2009 | Meloche et al. | |
| 7,654,801 | B2 | 2/2010 | Spude | |
| 7,658,598 | B2 | 2/2010 | Reed et al. | |
| 7,758,321 | B2 | 7/2010 | Fukano et al. | |
| 8,123,500 | B2 | 2/2012 | Juterbock et al. | |
| 8,167,586 | B2 | 5/2012 | Towne | |
| 8,182,247 | B2 | 5/2012 | Gallwey et al. | |
| 8,292,600 | B2 | 10/2012 | Reed et al. | |
| 8,313,313 | B2 * | 11/2012 | Juterbock | F04B 43/009 417/399 |
| 8,382,445 | B2 | 2/2013 | Roseberry | |
| 8,393,881 | B2 | 3/2013 | Usui et al. | |
| 8,485,792 | B2 | 7/2013 | McCourt et al. | |
| 8,529,223 | B2 | 9/2013 | Cohoon et al. | |
| 8,585,372 | B2 | 11/2013 | Bacher et al. | |
| 9,316,218 | B2 | 4/2016 | McCourt et al. | |
| 9,638,185 | B2 | 5/2017 | Hines et al. | |
| 2001/0048882 | A1 | 12/2001 | Layman | |
| 2004/0057853 | A1 | 3/2004 | Ross et al. | |
| 2004/0086398 | A1 | 5/2004 | Eugene et al. | |
| 2006/0127252 | A1 | 6/2006 | Caddell | |
| 2006/0257271 | A1 | 11/2006 | Juterbock et al. | |
| 2007/0092385 | A1 | 4/2007 | Petrie Pe | |
| 2009/0196771 | A1 | 8/2009 | Juterbock et al. | |
| 2010/0045096 | A1 | 2/2010 | Schonlau et al. | |
| 2010/0178184 | A1 | 7/2010 | Simmons et al. | |
| 2010/0196176 | A1 | 8/2010 | Kaufmann et al. | |
| 2012/0000561 | A1 | 1/2012 | Schuttermair et al. | |
| 2012/0063925 | A1 | 3/2012 | Parker | |
| 2012/0227389 | A1 | 9/2012 | Hinderks | |
| 2013/0008538 | A1 | 1/2013 | Schutze | |
| 2013/0101445 | A1 | 4/2013 | Schutze | |
| 2013/0183173 | A1 | 7/2013 | Kohli et al. | |
| 2013/0243630 | A1 | 9/2013 | Simmons et al. | |
| 2015/0226205 | A1 | 8/2015 | Hines et al. | |
| 2015/0226206 | A1 | 8/2015 | Hines et al. | |
| 2015/0226207 | A1 * | 8/2015 | Hines | F04B 1/14 417/374 |
| 2016/0377065 | A1 | 12/2016 | Parker | |

FOREIGN PATENT DOCUMENTS

| | | | |
|---|---|---|---|
| JP | 2004-210544 | A | 7/2004 |
| JP | 200629302 | A | 2/2006 |
| JP | 2006291957 | A | 10/2006 |
| JP | 2007500821 | A | 1/2007 |
| TW | 200606337 | A | 2/2006 |
| WO | WO 2012034238 | A1 | 3/2012 |

OTHER PUBLICATIONS

International Search Report and Written Opinion for PCT Application No. PCT/US2014/071950, dated Apr. 17, 2015, pp. 13.
International Search Report and Written Opinion for PCT Application No. PCT/US2014/071947, dated Apr. 20, 2015, pp. 11.
Extended European Search Report for EP Application No. 14881490.8, dated Aug. 23, 2017, pp. 7.
Taiwan Office Action for TW Application No. 103144852, dated Jun. 12, 2018, pp. 9.
Taiwan Office Action for TW Application No. 103144846, dated Jun. 12, 2018, pp. 9.
First Chinese Office Action for CN Application No. 201810016947.x, dated Oct. 31, 2018, pp. 10.
Japanese Office Action for JP Application No. 206550566, dated Dec. 12, 2018, pp. 9.
Japanese Office Action for JP Application No. 2016550593, dated Nov. 21, 2018, pp. 10.
Examination Report No. 1 for AU Application No. 2014381624, dated Apr. 27, 2018, pp. 4.
Examination Report No. 2 for AU Application No. 2014381624, dated Sep. 24, 2018, pp. 2.
Communication Pursuant to Article 94(3) EPC for EP Application No. 14881490.8, dated Jul. 19, 2018, pp. 3.
Extended European Search Report for EP Application No. 19182972.0, dated Sep. 11, 2019, pp. 5.
First Examination Report for AU Application No. 2019202483, dated May 11, 2020, pp. 3.

* cited by examiner

HIGH-PRESSURE POSITIVE DISPLACEMENT PLUNGER PUMP

CROSS-REFERENCE TO RELATED APPLICATION(S)

This application claims priority to U.S. Provisional Application No. 62/615,115 filed on Jan. 9, 2018, and entitled "HIGH PRESSURE POSITIVE DISPLACEMENT PLUNGER PUMP," the disclosure of which is hereby incorporated by reference in its entirety.

BACKGROUND

This disclosure relates to positive displacement pumps and more particularly to an internal drive system and displacement mechanism for positive displacement pumps.

Positive displacement pumps discharge a process fluid at a selected flow rate. In a typical positive displacement pump, a fluid displacement member, usually a piston or diaphragm, drives the process fluid through the pump. When the fluid displacement member is drawn in, a suction condition is created in the fluid flow path, which draws process fluid into a fluid cavity from the inlet manifold. The fluid displacement member then reverses direction and forces the process fluid out of the fluid cavity through the outlet manifold.

Air operated double displacement pumps typically employ diaphragms as the fluid displacement members. In an air operated double displacement pump, the two diaphragms are joined by a shaft, and compressed air is the working fluid in the pump. Compressed air is supplied to one of two diaphragm chambers, associated with the respective diaphragms. When compressed air is supplied to the first diaphragm chamber, the first diaphragm is deflected into the first fluid cavity, which discharges the process fluid from that fluid cavity. Simultaneously, the first diaphragm pulls the shaft, which is connected to the second diaphragm, drawing the second diaphragm in and pulling process fluid into the second fluid cavity. The compressed air that had previously driven the second diaphragm is typically exhausted to the atmosphere.

The delivery of compressed air is controlled by an air valve, and the air valve is usually mechanically actuated by the diaphragms. Thus, one diaphragm is pulled in until it causes the actuator to toggle the air valve. Toggling the air valve exhausts the compressed air from the first diaphragm chamber to the atmosphere and introduces fresh compressed air to the second diaphragm chamber, thus causing a reciprocating movement of the respective diaphragms. Alternatively, the first and second fluid displacement members could be pistons instead of diaphragms, and the pump would operate in the same manner.

Hydraulically driven double displacement pumps utilize hydraulic fluid as the working fluid, which allows the pump to operate at much higher pressures than an air driven pump. In a hydraulically driven double displacement pump, hydraulic fluid drives one fluid displacement member into a pumping stroke. That fluid displacement member is mechanically attached to the second fluid displacement member and thereby pulls the second fluid displacement member into a suction stroke. The hydraulic fluid is typically exhausted back to the hydraulic circuit as the fluid displacement members are pulled through the suction stroke. The use of hydraulic fluid and pistons enables the pump to operate at higher pressures than those achievable by an air driven diaphragm pump.

Alternatively, double diaphragm displacement pumps may be mechanically operated, without the use of air or hydraulic fluid. In these cases, the operation of the pump is essentially similar to an air operated double displacement pump, except compressed air is not used to drive the system. Instead, a reciprocating drive is mechanically connected to both the first fluid displacement member and the second fluid displacement member, and the reciprocating drive drives the two fluid displacement members into suction and pumping strokes.

SUMMARY

According to one aspect of the present disclosure, a pump for pumping a process fluid includes a housing defining an internal pressure chamber, the internal pressure chamber configured to contain a working fluid; a reciprocating member disposed within the internal pressure chamber; a fluid displacement component having a first surface and a second surface, the first surface configured to contact the working fluid and the second surface configured to contact the process fluid, wherein the fluid displacement component is configured such that pressure exerted on the first surface by the working fluid moves the second surface in a first direction towards the process fluid to expel the process fluid downstream, and wherein the area of the first surface is greater than the area of the second surface; and a pull extending between the reciprocating member and the fluid displacement component, the pull mechanically transferring a pulling force from the reciprocating member to the fluid displacement component to move the fluid displacement component in a second direction that is the opposite of the first direction, wherein the pull does not mechanically transfer a pushing force from the reciprocating member to the fluid displacement component when the reciprocating member moves in the first direction.

According to another aspect of the present disclosure, a pump for pumping a process fluid includes a housing defining an internal pressure chamber, the internal pressure chamber configured to contain a working fluid; a reciprocating member; a fluid displacement component having a first surface and a second surface, the first surface configured to contact the working fluid and the second surface configured to contact the process fluid, wherein the fluid displacement component is configured such that pressure exerted on the first surface by the working fluid moves the second surface in a first direction to expel the process fluid, and wherein the area of the first surface is greater than the area of the second surface; and a pull that links the reciprocating member to the fluid displacement component, the pull mechanically transferring a pulling force from the reciprocating member to the fluid displacement component to move the fluid displacement component in a second direction.

DETAILED DESCRIPTION

Figure 1:
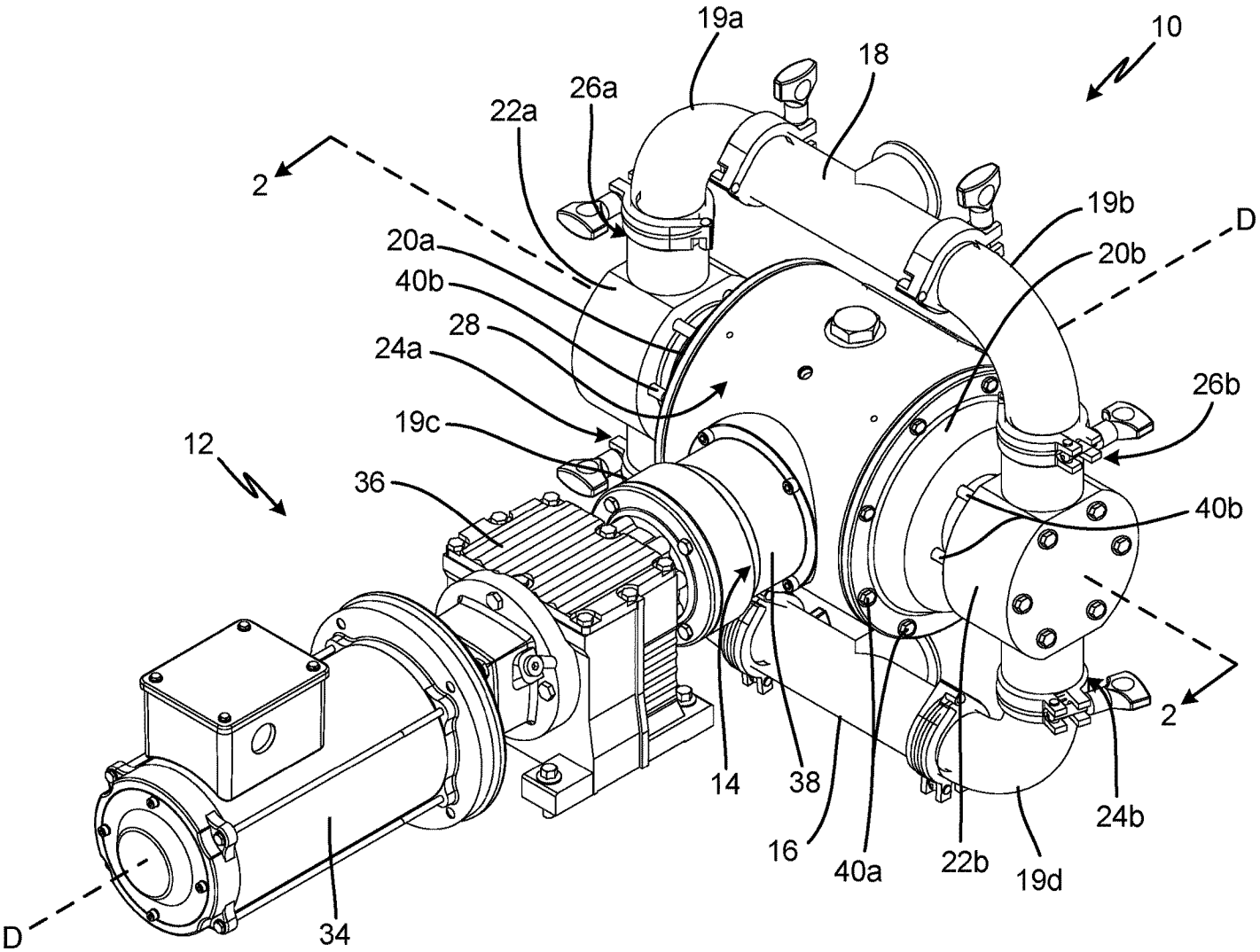
FIG. 1 is a rear perspective view of a pump, drive system, and motor.

FIG. 1 shows a perspective view of pump 10, electric drive 12, and drive system 14. Pump 10 includes inlet manifold 16; outlet manifold 18; fluid covers 20*a*, 20*b*; end covers 22*a*, 22*b*; inlet check valves 24*a*, 24*b*; and outlet check valves 26*a*, 26*b*. Drive system 14 includes housing 28 and piston guide 30. Housing 28 includes working fluid inlet 32. Electric drive 12 includes motor 34, gear reduction 36, and drive 38. Outlet manifold 18 includes elbows 19*a*, 19*b*. Inlet manifold 16 includes elbows 19*c*, 19*d*.

Housing 28 defines an internal drive chamber that at least partially accommodates drive 38 of electric drive 12. Fluid covers 20*a* and 20*b* are attached to housing 28 by fasteners 40*a*. End covers 22*a*, 22*b* are attached, respectively, to fluid covers 20*a*, 20*b* by fasteners 40*b* extending through end covers 22*a*, 22*b* into fluid covers 20*a*, 20*b*. Fasteners 40*a* and fasteners 40*b* can be any desired fastener suitable for connecting various components together for operation. For example, fasteners 40*a* and fasteners 40*b* can each be threaded bolts, but it is understood that any other desired type of fastener can be utilized. Elbows 19*a*, 19*b* provide a flowpath between outlet manifold 18 and end covers 22*a*, 22*b*, respectively. Elbows 19*c*, 19*d*, respectively, provide flowpaths between inlet manifold 16 and end covers 22*a*, 22*b*. While outlet manifold 18 is described as including elbows 19*a*, 19*b* and inlet manifold 16 is described as including elbows 19*c*, 19*d*, it is understood that outlet manifold 18 and inlet manifold 16 can include any suitable structure for providing flowpaths into and out of end covers 22*a*, 22*b*. It is further understood, that elbows 19*a*, 19*b* and elbows 19*c*, 19*d* can be separate from or integrated into outlet manifold 18 and inlet manifold 16, respectively.

Inlet check valves 24*a*, 24*b* (shown in FIG. 2) are disposed between inlet manifold 16 and end covers 22*a*, 22*b*, respectively. Outlet check valves 26*a*, 26*b* are disposed between outlet manifold 18 and end covers 22*a*, 22*b*, respectively. Inlet check valves 24*a*, 24*b*, and outlet check valves 26*a*, 26*b* are oriented to manage the flow of process fluid from inlet manifold 16 to outlet manifold 18. Inlet check valves 24*a*, 24*b*, and outlet check valves 26*a*, 26*b* prevent retrograde flow of process fluid from outlet manifold 18 to inlet manifold 16.

Motor 34 is attached to and drives gear reduction drive 38. Gear reduction drive 38 includes internal gearing (not shown) configured to reduce the output speed of motor 34 to a desired driving speed for drive 38. Gear reduction drive 38 powers drive 38 to cause the pumping of pump 10. Drive 38 is secured to housing 28 and extends at least partially into a drive chamber defined by housing 28.

Housing 26 is filled with a working fluid, either a gas, such as compressed air, or a non-compressible hydraulic fluid, through working fluid inlet 30. When the working fluid is a non-compressible hydraulic fluid, housing 26 may further include an accumulator (not shown) for storing a portion of the non-compressible hydraulic fluid during an overpressurization event.

As explained in more detail below, drive 38 causes drive system 14 to draw process fluid from inlet manifold 16 into either of the two flowpaths through end covers 22*a*, 22*b*. The working fluid in housing 26 causes a fluid displacement member internal to pump 10 to discharge the process fluid from either flowpath though end covers 22*a*, 22*b* to outlet manifold 18. Inlet check valves 24*a*, 24*b* prevent the process fluid from backflowing into inlet manifold 16 while the process fluid is being discharged to outlet manifold 18. Similarly, outlet check valves 26*a*, 26*b* prevent the process fluid from backflowing into either flowpath from outlet manifold 18 as the process fluid is drawn into the flowpaths from inlet manifold 16.

Figure 2A:
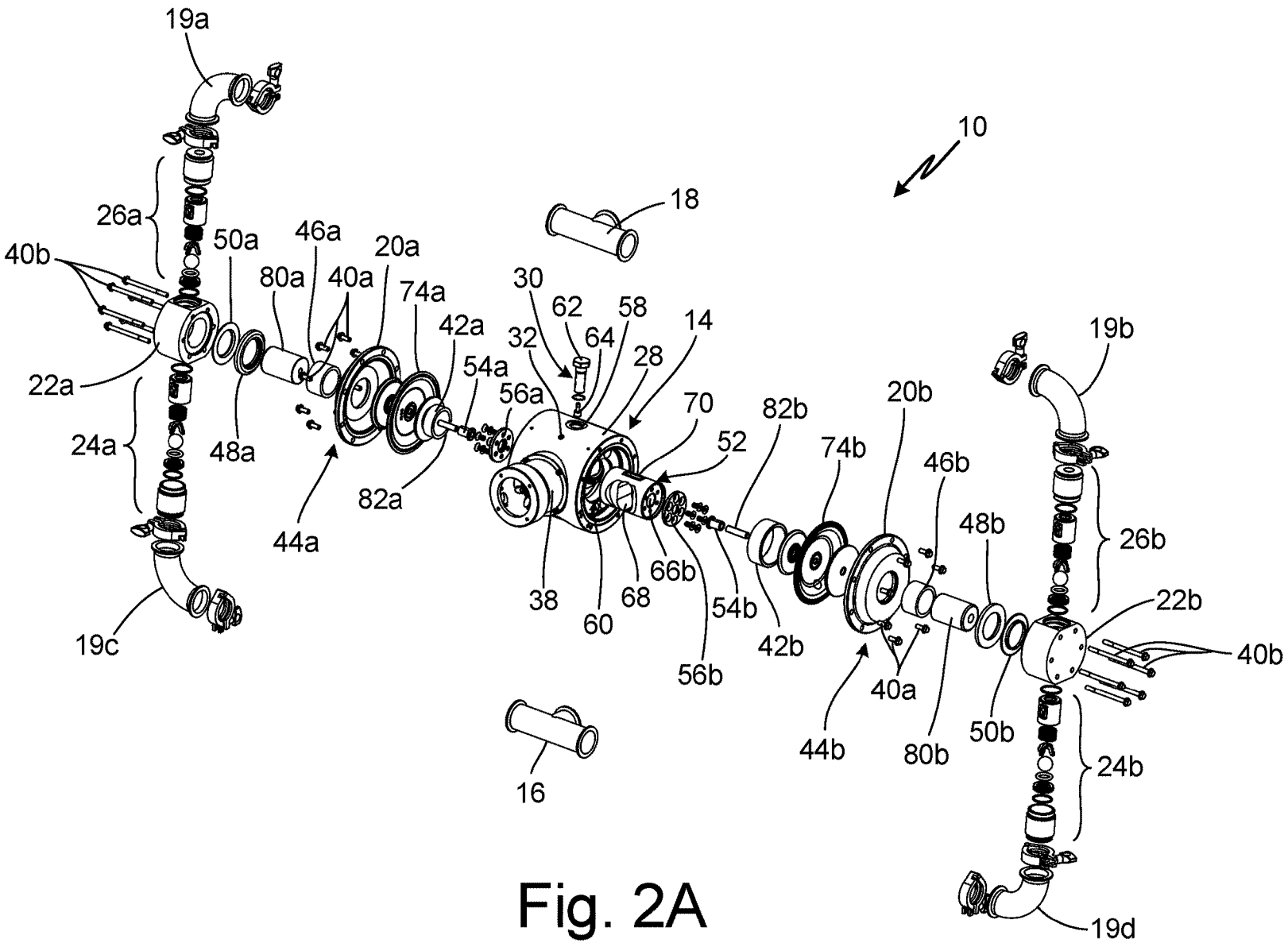
FIG. 2A is an exploded perspective view of the pump, drive system, and drive of FIG. 1.
Figure 2B:
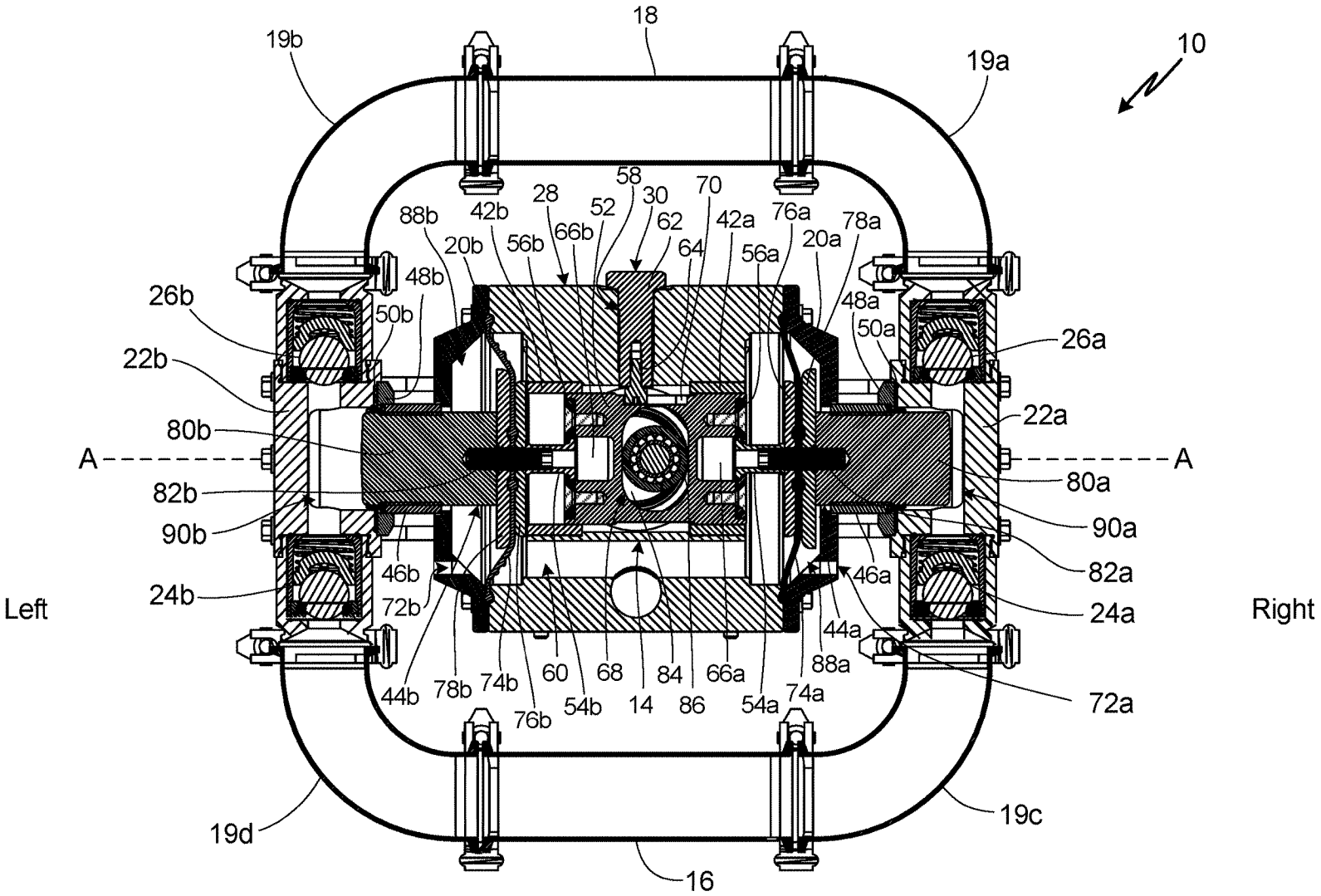
FIG. 2B is a cross-sectional view, taken along line 2-2 in FIG. 1.

FIG. 2A is an exploded, perspective view of pump 10. FIG. 2B is a cross-sectional view of pump 10 taken along line 2-2 in FIG. 1. FIGS. 2A and 2B will be discussed together. Pump 10 includes inlet manifold 16; outlet manifold 18; fluid covers 20*a*, 20*b*; end covers 22*a*, 22*b*; inlet check valves 24*a*, 24*b*; outlet check valves 26*a*, 26*b*; bushings 42*a*, 42*b*; fluid displacement components 44*a*, 44*b*; outer cylinders 46*a*, 46*b*; collars 48*a*, 48*b*; and sealing rings 50*a*, 50*b*. Drive system 14 includes housing 28; piston guide 30; piston 52; pulls 54*a*, 54*b*; and face plates 56*a*, 56*b*. Housing 28 includes working fluid inlet 32 and guide opening 58. Housing 28 defines internal pressure chamber 60. Piston guide 30 includes barrel nut 62 and guide pin 64. Piston 52 includes pull chambers 66*a*, 66*b*; central slot 68; and axial slot 70. Fluid covers 20*a*, 20*b* include, respectively, ports 72*a*, 72*b*. Fluid displacement components 44*a*, 44*b* include, respectively, diaphragms 74*a*, 74*b*; inner plates 76*a*, 76*b*; outer plates 78*a*, 78*b*; plungers 80*a*, 80*b*; attachment members 82*a*, 82*b*. Outlet manifold 18 includes elbows 19*a*, 19*b*. Inlet manifold 16 includes elbows 19*c*, 19*d*. Drive 38 of electric drive 12 (FIG. 1) is shown. As shown in FIG. 2B, drive 38 includes drive shaft 84 and cam follower 86.

A left-right directional convention is indicated on FIG. 2B. "Inner" as used herein refers to being closer to the axis of drive shaft 84 and/or cam follower 86 while "outer" as used herein refers to being further away from the axis of drive shaft 84 and/or the follower 86 along pump axis A-A in either the left or right direction.

Housing 28 is disposed between fluid cover 20*a* and fluid cover 20*b*. Outer cylinder 46*a* extends between and is retained between fluid cover 20*a* and end cover 22*a*. Outer cylinder 46*b* extends between and is retained between fluid cover 20*b* and end cover 22*b*. Inlet manifold 16 is configured to provide process fluid to pumping chambers 90*a*, 90*b* (FIG. 2B) within end covers 22*a*, 22*b*. Elbow 19*c* extends to end cover 22*a*, and elbow 19*d* extends to end cover 22*b*. Inlet check valve 24*a* is disposed between end cover 22*a* and elbow 19*c*. Inlet check valve 24*b* is disposed between end cover 22*b* and elbow 19*d*. Inlet check valves 24*a*, 24*b* allow the process fluid to flow into end covers 22*a*, 22*b*, while preventing the process fluid from backflowing out of end covers 22*a*, 22*b* to inlet manifold 16. While inlet check valves 24*a*, 24*b* are shown as ball and seat-type check valves, it is understood that any suitable valve for preventing backflow of the process fluid can be utilized.

Outlet manifold 18 is configured to receive process fluid from pumping chambers 90*a*, 90*b*. Elbow 19*a* extends from end cover 22*a*, and elbow 19*b* extends from end cover 22*b*. Outlet check valve 26*a* is disposed between end cover 22*a* and elbow 19*a*. Outlet check valve 26*b* is disposed between end cover 22*b* and elbow 19*b*. Outlet check valves 26*a*, 26*b* allow the process fluid to flow out of end covers 22*a*, 22*b*, while preventing the process fluid from backflowing into end covers 22*a*, 22*b* from outlet manifold 18. While outlet check valves 26*a*, 26*b* are shown as ball and seat-type check valves, it is understood that any suitable valve for preventing backflow of the process fluid can be utilized.

Piston 52 is disposed within housing 28 and is configured to be driven in a reciprocating manner along pump axis A-A by drive 38. Drive shaft 84 is powered by electric drive 12

(FIG. 1). Cam follower 86 extends from drive shaft 84 into central slot 68 of piston 52 to drive the reciprocation of piston 52. Cam follower 86 engages the walls defining central slot 68 of piston 52. Bushings 42*a*, 42*b* are disposed within and supported by housing 28. Piston 52 is disposed within, and rides on, bushings 42*a*, 42*b*, which restrict piston 52 to lateral (left and right) motion. As shown, cam follower 86 is offset from the axial center of the drive shaft 84 such that cam follower 86 orbits the axis of drive shaft 84, instead of merely rotating about its own axis. Due to cam follower 86 being located within vertically orientated central slot 68 of piston 52, cam follower 86 does not push piston 52 up or down. Instead, cam follower 86 forces piston 52 to reciprocate laterally left and right along pump axis A-A. While pump 10 is described as including piston 52, it is understood that any desired type of reciprocating member can be utilized, which may include, but is not limited to, a scotch yoke or other reciprocating drive.

Piston guide 30 extends through housing 28 and is configured to prevent piston 52 from rotating about piston axis A-A. Barrel nut 62 extends through guide opening 58, and guide pin 64 is connected to barrel nut 62. As shown, guide pin 64 rides within axial slot 70 of piston 52 to prevent piston 52 from rotating about piston axis A-A. Piston guide 28 thereby ensures that the motion of piston 52 is limited to reciprocation along piston axis A-A.

Piston 52 includes pull chamber 66*a* disposed within a first end of piston 52 and pull chamber 66*b* disposed within a second, opposite end of piston 52. Face plates 56*a*, 56*b* are disposed at opposite ends of piston 52 and cap pull chambers 66*a*, 66*b*. Face plates 56*a*, 56*b* are configured to retain pulls 54*a*, 54*b*, within pull chambers 66*a*, 66*b* of piston 52. Face plates 56*a*, 56*b* include fastener openings to facilitate connection with piston 52. Any desired fastener, such as a bolt, can extend through the fastener openings into piston 52 to secure face plates 56*a*, 56*b* to piston 52. Pulls 54*a*, 54*b* extend out of pull chambers 66*a*, 66*b* through the openings in face plates 56*a*, 56*b*.

Pump 10 includes fluid displacement components 44*a*, 44*b*. In the present embodiment, fluid displacement components 44*a*, 44*b* are shown to include diaphragms 74*a*, 74*b*, respectively. It is understood, however, that fluid displacement components 44*a*, 44*b* can omit diaphragms or other illustrated components. Fluid displacement components 44*a*, 44*b* can be or contain pistons or any other suitable component for displacing process fluid. Additionally, while pump 10 is described as a double displacement pump, utilizing dual fluid displacement components 44*a*, 44*b*, it is understood that a single fluid displacement component may be used in a pump (e.g., with only one diaphragm or piston). As such, various examples of pump 10 can be single-displacement or double-displacement pumps.

Fluid covers 20*a*, 20*b* are secured to opposite ends of housing 28 by fasteners 40*a* extending through fluid covers 20*a*, 20*b* into housing 28. Ports 72*a*, 72*b* extend through fluid covers and fluidly connect outer chambers 88*a*, 88*b*, which are defined by diaphragms 74*a*, 74*b* and fluid covers 20*a*, 20*b*, with the atmosphere. Diaphragm 74*a* is secured between housing 28 and fluid cover 20*a* to define and seal, in part, internal pressure chamber 60. Similarly, diaphragm 74*b* is secured between housing 28 and end cover fluid cover 20*b* to define and seal, in part, internal pressure chamber 60. Diaphragms 74*a*, 74*b* are configured to flex and spring back to a nominal shape. For example, diaphragms 74*a*, 74*b* can be elastic disks. Diaphragms 74*a*, 74*b* are sandwiched between inner plates 76*a*, 76*b* and outer plates 78*a*, 78*b*. Inner plates 76*a*, 76*b* are disposed on a side of diaphragms 74*a*, 74*b* facing internal pressure chamber 60. Outer plates 78*a*, 78*b* are disposed on a side of diaphragms 74*a*, 74*b* facing outer chambers 88*a*, 88*b*.

Diaphragm 74*a* defines, in part, two chambers: internal pressure chamber 60 and outer chamber 88*a*. Diaphragm 74*b* also defines, in part, two chambers: internal pressure chamber 60*a* and outer chamber 88*b*. Internal pressure chamber 60 is defined by housing 28 and diaphragms 74*a*, 74*b*. Outer chambers 88*a*, 88*b* are further defined in part by fluid covers 20*a*, 20*b*. The volume of outer chambers 88*a*, 88*b* changes inversely with a change in the volume of internal pressure chamber 60 due to the movement of the diaphragms 74*a*, 74*b*. For example, when diaphragm 74*a* is pushed rightward the volume in outer chamber 88*a* becomes smaller. Such change in volume in outer chamber 88*a* could increase the pressure within the outer chamber 88*a*, thereby increasing a countervailing force pushing diaphragm 74*a* leftward against the force generated by the fluid charge in internal pressure chamber 60. Likewise, leftward movement of diaphragm 74*a* could create a suction or vacuum condition in outer chamber 88*a*. However, ports 72*a*, 72*b* provide vent paths for outer chambers 88*a*, 88*b* to prevent overpressure or vacuum conditions from developing in outer chambers 88*a*, 88*b* during pumping, which conditions can cause inefficient pumping.

In some examples, outer chambers 88*a*, 88*b* can be sealed to prevent fluid from escaping outer chambers 88*a*, 88*b*. In such an example, outer chambers 88*a*, 88*b* can be charged with a fluid (gas or liquid), the presence of which may prevent process fluid or working fluid from escaping into and through the outer chambers 88*a*, 88*b*. The charge fluid in outer chambers 88*a*, 88*b* can thereby prevents contamination of the process fluid or working fluid in the event of seal failure.

Plungers 80*a*, 80*b* extend from outer plates 78*a*, 78*b*, through outer cylinders 46*a*, 46*b*, and into pumping chambers 90*a*, 90*b*. Diaphragms 74*a*, 74*b* are attached to plungers 80*a*, 80*b* by attachment members 82*a*, 82*b*. Attachment members 82*a*, 82*b* can connect diaphragms 74*a*, 74*b* and plungers 80*a*, 80*b* in any desired manner. For example, attachment members 82*a*, 82*b* can threadedly engage the central holes in plungers 80*a*, 80*b* and pulls 54*a*, 54*b*, sandwiching and securing inner plates 76*a*, 76*b*; the central portions of diaphragms 74*a*, 74*b*; and outer plates 78*a*, 78*b* therebetween. As such, pull 54*a*, attachment member 82*a*, diaphragm 74*a*, inner plate 76*a*, outer plate 78*a*, and plunger 80*a* are attached as an assembly and move together. Similarly, pull 54*b*, attachment member 82*b*, diaphragm 74*b*, inner plate 76*b*, outer plate 78*b*, and plunger 80*b* are attached as an assembly and move together. While attachment members 82*a*, 82*b* are used to connect the central portions of diaphragms 74*a*, 74*b* with plungers 80*a*, 80*b*, it is understood that plungers 80*a*, 80*b* can be connected to diaphragms 74*a*, 74*b* in any desired manner. For example, outer plates 78*a*, 78*b* can be partially or wholly embedded in the material that forms diaphragms 74*a*, 74*b*, and plungers 80*a*, 80*b* can be connected (e.g., adhered, welded, bolted, or threadedly attached) to outer plates 78*a*, 78*b*. In another example, plungers 80*a*, 80*b* are at least partially embedded in the material that forms diaphragms 74*a*, 74*b*, thereby omitting outer plates 78*a*, 78*b*. In another example, plungers 80*a*, 80*b* and outer plates 78*a*, 78*b* are integrally formed as a single part.

Fasteners 40*b* extend through end covers 22*a*, 22*b* and into fluid covers 20*a*, 20*b*, clamping outer cylinders 46*a*, 46*b* therebetween. Plungers 80*a*, 80*b* extend into pumping chambers 90*a*, 90*b* through outer cylinders 46*a*, 46*b*. Pumping chambers 90*a*, 90*b* are formed between end covers 22*a*, 22*b* and plungers 80*a*, 80*b*. Plungers 80*a*, 80*b* are configured to slide within outer cylinders 46*a*, 46*b* and into and out of pumping chambers 90*a*, 90*b*. The diameter of the outer circumference of plungers 80*a*, 80*b* is slightly less than the diameter of the inner circumference of outer cylinders 46*a*, 46*b*. As such, the outer circumferential surface of plungers 80*a*, 80*b* interfaces with the inner circumferential surface of outer cylinders 46*a*, 46*b*. These surfaces can be dimensioned to move relative to each other but also seal between themselves. Likewise, the inner surfaces of the inside entrances to end covers 22*a*, 22*b* are cylindrical and interface with the outer circumferential surface of plungers 80*a*, 80*b* to limit or prevent leakage of process fluid past the interface of plungers 80*a*, 80*b* and end covers 22*a*, 22*b*.

Collars 48*a*, 48*b* are disposed adjacent the inner sides of end covers 22*a*, 22*b*. Collars 48*a*, 48*b* receive an outer end of outer cylinders 46*a*, 46*b*. Sealing rings 50*a*, 50*b* are disposed between collars 48*a*, 48*b* and end covers 22*a*, 22*b*. Sealing rings 50*a*, 50*b* extend around and interface with an outer edge of plungers 80*a*, 80*b*. Sealing rings 50*a*, 50*b* seal circumferentially about plungers 80*a*, 80*b* to prevent process fluid within pumping chambers 90*a*, 90*b* from escaping along the periphery of the plungers 80*a*, 80*b*. Likewise, sealing rings 50*a*, 50*b* can prevent working fluid that has escaped from internal pressure chamber 60 (or from another source) from entering pumping chambers 90*a*, 90*b* and contaminating the process fluid. While pump 10 is described as including outer cylinders 46*a*, 46*b* and collars 48*a*, 48*b*, it is understood that end covers 22*a*, 22*b* can directly abut fluid covers 20*a*, 20*b*. In such an example, sealing rings 50*a*, 50*b* can be retained between fluid covers 20*a*, 20*b* and end covers 22*a*, 22*b*.

Internal pressure chamber 60 is configured to be charged with a working fluid during operation of pump 10. The working fluid is either a gas, such as compressed air, or a non-compressible hydraulic fluid. The output pressure from pump 10 is set by charging the working fluid in internal pressure chamber 60 to a desired operational pressure. The working fluid is configured to drive each fluid displacement component 44*a*, 44*b* through a pumping stroke, where plungers 80*a*, 80*b* are driven into pumping chambers 90*a*, 90*b* to reduce the volume of pumping chambers 90*a*, 90*b* and drive the process fluid downstream out of pumping chambers 90*a*, 90*b* to outlet manifold 18. Piston 52 is configured to draw each fluid displacement component 44*a*, 44*b* through a suction stroke, where plungers 80*a*, 80*b* are pulled out of pumping chambers 90*a*, 90*b* to increase the volume of pumping chambers 90*a*, 90*b* and draw the process fluid upstream into pumping chambers 90*a*, 90*b* from inlet manifold 16.

During operation, drive shaft 84 rotates about its axis and causes orbital movement of cam follower 86 about driveshaft axis D-D (shown in FIG. 1). Cam follower 86 drives the oscillation of piston 52 along piston axis A-A. Pulls 54*a*, 54*b* facilitate mechanical pulling of fluid displacement components 44*a*, 44*b* during suction strokes, but not pushing on fluid displacement components 44*a*, 44*b* during pumping strokes. Pulls 54*a*, 54*b* and piston 52 are configured such that pulls 54*a*, 54*b* are unable to exert sufficient pressure on fluid displacement components 44*a*, 44*b* to cause fluid displacement components 44*a*, 44*b* to proceed through a pumping stroke. While pump 10 is shown as including pulls 54*a*, 54*b*, it is understood that any desired intermediate component capable of pulling in tension but not pushing in compression can connect piston 52 to fluid displacement components 44*a*, 44*b*.

Pulls 54*a*, 54*b* are slidably disposed within pull chambers 66*a*, 66*b*. Each pull 54*a*, 54*b* has a main body that extends through the pull opening in face plate 56*a*, 56*b*. The respective ends of pulls 54*a*, 54*b* disposed within pull chambers 66*a*, 66*b* are flanged, such that the flanged end of each pull 54*a*, 54*b* has a wider diameter than the main body portion of each pull 54*a*, 54*b*. While the diameters of pulls 54*a*, 54*b* along the main bodies are small enough to slide through the central openings of face plates 56*a*, 56*b*, the diameter of the flanged ends of pulls 54*a*, 54*b* are too large to fit through the central openings of face plates 56*a*, 56*b*.

Face plates 56*a*, 56*b* are configured to engage the flanged ends of pulls 54*a*, 54*b* to facilitate the suction stoke of each fluid displacement components 44*a*, 44*b*. Piston 52 is thereby capable of pulling pulls 54*a*, 54*b*, and thus fluid displacement components 44*a*, 44*b*, inward through a suction stroke, but is incapable of pushing fluid displacement components 44*a*, 44*b* outward through a pumping stroke. Pull chambers 66*a*, 66*b* are dimensioned such that pulls 54*a*, 54*b* simply slide further into pull chambers 66*a*, 66*b* as piston 52 moves toward fluid displacement components 44*a*, 44*b*.

Piston 52 is driven leftward and rightward along piston axis A-A by cam follower 86. As piston 52 moves leftward, piston 52 pulls, by way of face plate 56*a*, pull 54*a* to the left. Piston 52 thereby pulls fluid displacement component 44*a* to the left due to the connection of pull 54*a* and fluid displacement component 44*a*. However, the flanged end of pull 54*a* can move within pull chamber 66*a*, so when piston 52 reaches the end of the leftward travel and reverses to rightward travel, the flanged end of pull 54*a* can slide relative to piston 52 within pull chamber 66*a*. As such, piston 52 is prevented from pushing on pull 54*a* as piston 52 moves rightward. Piston 52 thereby does not drive fluid displacement component 44*a* rightward through a pumping stroke. Instead, what moves fluid displacement component 44*a* rightward is the charge pressure of the working fluid within internal pressure chamber 60 pushing on the inner side of the fluid displacement component 44*a*, and specifically on inner plate 76*a* and the diaphragm 74*a*.

Inward movement, to the left, of fluid displacement component 44*a*, due to the connection of fluid displacement component 44*a* with piston 52 via pull 54*a* and face plate 56*a*, partially withdraws the outer end of plunger 80*a* from pumping chamber 90*a* within end cover 22*a*. Such movement increases the available volume within the pumping chamber 90*a*, creating a suction condition that opens inlet check valve 24*a* and draws the process fluid from inlet manifold 16 into pumping chamber 90*a* past inlet check valve 24*a*. The suction condition also causes outlet check valve 26*a* to close, thereby preventing retrograde flow of process fluid from outlet manifold 18 into pumping chamber 90*a*.

As piston 52 travels leftward the charge pressure of the working fluid within internal pressure chamber 60 drives fluid displacement component 44*b* leftward through a pumping stroke. Piston 52 does not mechanically force fluid displacement component 44*b* to move leftward (outward) because the inner flanged end of pull 54*b* slides within pull chamber 66*b*, preventing piston 52 from pushing on pull 54*b*. Instead, the charge pressure of the working fluid in internal pressure chamber 60 pushes fluid displacement component 44*b*, and specifically diaphragm 74*b* and inner plate 76*b*, thereby forcing plunger 80*b* further into pumping chamber 90*b*. Forcing plunger 80*b* into pumping chamber 90*b* reduces the available volume within pumping chamber 90*b*, increasing the pressure within pumping chamber 90*b*.

The increased pressure causes outlet check valve 26*b* to open and drives the process fluid downstream out of pumping chamber 90*b* through outlet check valve 26*b*. The process fluid flows out of pumping chamber 90*b* into outlet manifold 18. The increased pressure in pumping chamber 90*b* due to the advancement of plunger 80*b* also causes inlet check valve 24*b* to close, thereby preventing retrograde flow of process fluid from pumping chamber 90*b* upstream past inlet check valve 24*b*.

After piston 52 reaches the furthest extent of its leftward movement, piston 52 reverses course and is driven rightward by cam follower 86. As discussed above, the charge pressure of the working fluid drives fluid displacement component 44*a* through a pumping stroke as piston 52 moves rightward, and piston 52 pulls fluid displacement component 44*b* through a suction stroke as piston 52 moves rightward.

As piston 52 moves rightward, piston 52 pulls pull 54*b*, by way of face plate 56*b*, to the right. Piston 52 thereby pulls fluid displacement component 44*b* to the right, causing fluid displacement component 44*b* to proceed through a suction stroke. However, the flanged end of pull 54*b* can move within pull chamber 66*b*. As such, when piston 52 reaches the end of its rightward travel and reverses to leftward travel, the flanged end of pull 54*b* can slide relative to piston 52 within pull chamber 66*b*, and piston 52 is prevented from pushing on pull 54*b* as piston 52 moves leftward. Piston 52 thereby does not drive fluid displacement component 44*b* leftward through a pumping stroke. Instead, the charge pressure within internal pressure chamber 60 pushing on the inner side of the fluid displacement component 44*b*, and specifically on inner plate 76*b* and the diaphragm 74*b*, moves fluid displacement component 44*b* leftward through a pumping stroke.

Inward movement, to the right, of fluid displacement component 44*b*, due to the connection of fluid displacement component 44*b* and piston 52 via pull 54*b* and face plate 56*b*, partially withdraws the outer end of plunger 80*b* from pumping chamber 90*b* within end cover 22*b*. Such movement increases the available volume within the pumping chamber 90*b*, creating a suction condition that opens inlet check valve 24*b* and draws the process fluid from inlet manifold 16 into pumping chamber 90*b* past inlet check valve 24*b*. The suction condition also causes outlet check valve 26*b* to close, thereby preventing retrograde flow of process fluid from outlet manifold 18 into pumping chamber 90*b*.

As piston 52 travels rightward the charge pressure of the working fluid within internal pressure chamber 60 drives fluid displacement component 44*a* rightward through a pumping stroke. Piston 52 does not mechanically force fluid displacement component 44*a* to move rightward (outward) because the inner flange end of pull 84*a* slides within pull chamber 66*a*. Instead, it is the charge pressure of the working fluid in internal pressure chamber 60 that pushes fluid displacement component 44*a*, and specifically diaphragm 74*a* and inner plate 76*a*, forcing plunger 80*a* further into pumping chamber 90*a*. Forcing plunger 80*a* into pumping chamber 90*a* reduces the available volume within pumping chamber 90*a*, increasing the pressure within pumping chamber 90*a*, thereby causing outlet check valve 26*a* to open and driving the process fluid downstream out of pumping chamber 90*a* through outlet check valve 26. The process fluid flows out of pumping chamber 90*a* into outlet manifold 18. The increased pressure in pumping chamber 90*a* due to the advancement of plunger 80*a* causes inlet check valve 24*a* to close, thereby preventing retrograde flow of process fluid from pumping chamber 90*a* upstream past inlet check valve 24*a*.

Fluid displacement components 44*a*, 44*b* are thereby mechanically pulled through their respective suction strokes, but are not mechanically pushed during their respective pumping strokes. Instead, the charge pressure of the working fluid within internal pressure chamber pushes, either pneumatically or hydraulically, on the inner side of fluid displacement components 44*a*, 44*b* to drive fluid displacement components 44*a*, 44*b* through their respective pumping strokes.

Pump 10 and the alternating use of piston 52 to mechanically pull, but not mechanically push, the fluid displacement components 44*a*, 44*b* during the suction stroke, and use of a charge of pressurized fluid within internal pressure chamber 60 to pneumatically or hydraulically push, but not pull, fluid displacement components 44*a*, 44*b* during the pumping stroke provides significant advantages. Piston 52 is prevented from exerting an uncompromising mechanical pushing force on either fluid displacement component 44*a*, 44*b*, which would otherwise risk dramatically spiking the pressure within the process fluid, particularly when an outlet for the process fluid is suddenly shutoff or otherwise blocked (known as a deadhead condition). In some embodiments of the present disclosure, all of the pressure placed on the process fluid by pump 10 is generated by the charge of the pressurized working fluid within internal pressure chamber 60.

If the pressure in the process fluid exceeds the pressure in the working fluid, then fluid displacement components 44*a*, 44*b* will not be pushed through a pumping stroke, thus avoiding a spike in process fluid pressure. In the deadhead condition, drive 38 will continue to drive the oscillation of piston 52, but pulls 54*a*, 54*b* and fluid displacement components 44*a*, 44*b* will remain in a retracted (suction stroke) position over one or multiple reciprocation cycles of piston 52. Fluid displacement components 44*a*, 44*b* remain in the retracted position because the working fluid pressure is insufficient to push fluid displacement components 44*a*, 44*b*, through a pumping stroke. One or both of fluid displacement components 44*a*, 44*b*, will be remain in the retracted position until the downstream pressure of the process fluid decreases to a level below the working fluid pressure, such that the working fluid pressure can cause fluid displacement components 44*a*, 44*b* to enter their respective pumping strokes. Allowing piston 52 to continue to oscillate without pushing either fluid displacement component 44*a*, 44*b* into a pumping stroke allows pump 10 to continue to run during the deadhead condition without causing any harm to the motor or pump. As piston 54 continues to oscillate, pulls 54*a*, 54*b* will simply slide within pull chambers 66*a*, 66*b* without imparting the pushing force to fluid displacement components 44*a*, 44*b* necessary to initiate the pumping stroke. Allowing pump 10 to continue to run prevents undesired wear to components of pump 10 that can occur due to repeated start up and shut down. In addition, allowing pump 10 to continue to run increases the efficiency of the pumping operation, as the user is not required to stop and start pump 10 whenever the user desired to close the outlet. Moreover, damage to various components of pump 10 is avoided, as electric drive 12 (FIG. 1) and drive 14 will not experience unexpected resistance during the deadhead, as pulls 54*a*, 54*b* simply slide within pull chambers 66*a*, 66*b* instead of transmitting forces to piston 52 from fluid displacement members 44*a*, 44*b*.

Another benefit, in some embodiments, is a reduction or elimination of downstream pulsation of the process fluid. A constant downstream pressure can be produced by pump 10 to eliminate pulsation by sequencing the speed of piston 52 with the pumping stroke caused by the working fluid. Sequencing the suction and pumping strokes can prevent drive system 14 from entering a state of rest where one fluid displacement member 44*a*, 44*b* completes a pumping stroke prior to piston 52 reversing course along pump axis A-A.

Piston 52 is sequenced by setting the speed of oscillation and/or the pressure of the working fluid such that when piston 52 begins to pull one fluid displacement component 44*a*, 44*b* into a suction stroke prior to that fluid displacement component 44*a*, 44*b* completing a pumping stroke. This is possible because piston 52 can pull one fluid displacement component 44*a*, 44*b* through a suction stroke faster than the working fluid charge pressure can drive the other fluid displacement component 44*a*, 44*b* through an entire pumping stroke. The difference in speed can be achieved due to the different causes of pulling (mechanical) and pushing (fluid). Therefore, at least one fluid displacement component 44*a*, 44*b* is always moving in a pumping stroke, which eliminates pulsation because process fluid is constantly discharged to outlet manifold 18 at a constant rate.

Moreover, pump 10 can generate higher output pressures in the process fluid than the charge pressure of the working fluid. The respective surface areas of fluid displacement components 44*a*, 44*b* on which the working fluid directly contacts and pushes are larger than the respective surface areas of fluid displacement components 44*a*, 44*b* that directly contact and push on the process fluid.

More specific to the illustrated embodiment, the diameter of the inner parts of fluid displacement components 44*a*, 44*b* that contact and are pushed upon by the working fluid (e.g., defined by diaphragms 74*a*, 74*b* and inner plates 76*a*, 76*b*) is larger than the diameter of the outer end faces of plungers 80*a*, 80*b* that contact and push upon the process fluid. Therefore, while the lateral travel of the working fluid-contacting surface and the process fluid-contacting surface of fluid displacement components 44*a*, 44*b* are the same, the displacements of the working fluid and the process fluid will be different for every stroke due to the difference in diameters and overall fluid-contacting surface areas. The displacement of process fluid by the outer ends of plungers 80*a*, 80*b* is smaller for each stroke as compared to the displacement of working fluid, but the pressure generated in the process fluid is greater than the pressure of the working fluid acting on fluid displacement components 44*a*, 44*b*. This generates higher process fluid pressure within pumping chambers 90*a*, 90*b*. The process fluid pressure is higher even than the working fluid pressure in internal pressure chamber 60. Therefore, the pumping pressure developed in pumping chambers 90*a*, 90*b* and further downstream due to the pumping strokes of fluid displacement components 44*a*, 44*b* can be higher than the working fluid pressure that acts upon and pushes fluid displacement components 44*a*, 44*b*. The pressure multiplication provides a more compact pump 10, as pump 10 can provide higher pumping pressures in a more compact arrangement due to the variations in surface area. Moreover, pump 10 has increased efficiency, as less energy is required to charge the working fluid to achieve the desired output pressure.

High pressure output of process fluid is beneficial in various applications of fluid handling, such as for dispensing or spraying viscous fluid. Embodiments of the present disclosure extend the output pressure from pump 10 above the supply pressure while still allowing the downstream outlet of pump 10 to be shutoff or otherwise deadheaded without concern of spiking pressure or damaging pump 10. For example, the user may only have a 100 PSI compressor available for generating the initial charge of working fluid within internal pressure chamber 60. The mechanical advantage gained by fluid displacement components 44*a*, 44*b* having different sized working/process fluid contacting surfaces, and therefore different working/process fluid displacements, allows the output pressure of process fluid to be significantly higher than 100 PSI. Moreover, the user's application may further require frequent starting and stopping of process fluid dispenses, which results in frequent deadheading of the fluid. Pulls 54*a*, 54*b* avoid pressure spikes and prevent pump 10 from suffering damage that can otherwise result from frequent starting and stopping of process fluid dispenses. Pulls 54*a*, 54*b* house within pull chambers 66*a*, 66*b* and prevent piston 52 from pushing on fluid displacement components 44*a*, 44*b*, while facilitating piston 52 pulling fluid displacement components 44*a*, 44*b*.

When compressed air is used as the working fluid, drive system 14 eliminates the possibility of exhaust icing, as can be found in air-driven pumps, because the compressed air in drive system 14 is not exhausted after each stroke. Other exhaust problems are also eliminated, such as safety hazards that arise from exhaust becoming contaminated with process fluids. Additionally, higher energy efficiency can be achieved with drive system 14 because internal pressure chamber 60 eliminates the need to provide a fresh dose of compressed air during each stroke, as is found in typical air operated pumps. When a non-compressible hydraulic fluid is used as the working fluid, drive system 14 eliminates the need for complex hydraulic circuits with multiple compartments, as can be found in typical hydraulically driven pumps. Additionally, drive system 14 eliminates the contamination risk between the process fluid and the working fluid due to the balanced forces on either side of fluid displacement components 44*a*, 44*b*.

Figure 3:
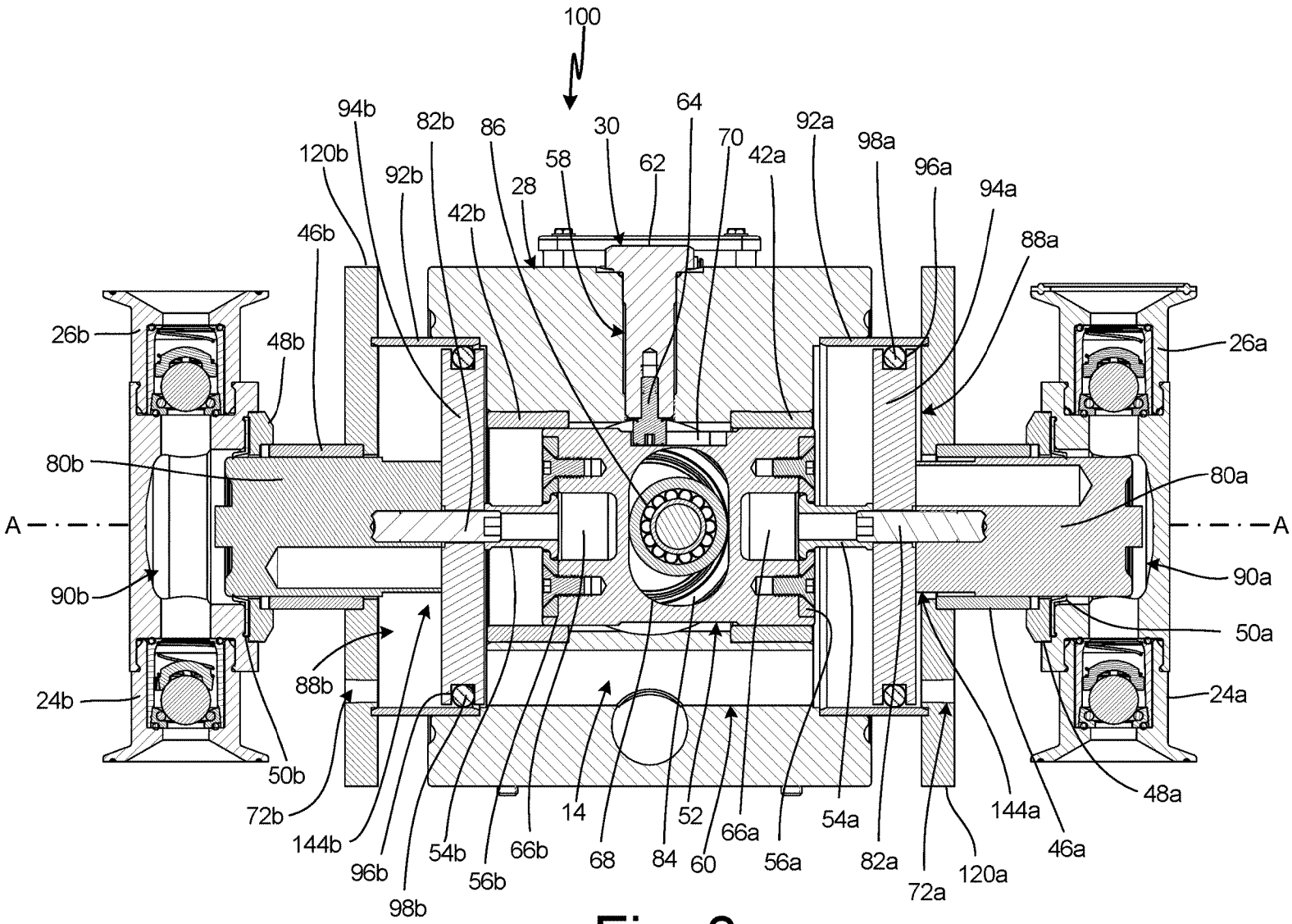
FIG. 3 is a cross-sectional view of a second pump.

FIG. 3 is a cross-sectional view of pump 100. Pump 100 includes end covers 22*a*, 22*b*; inlet check valves 24*a*, 24*b*; outlet check valves 26*a*, 26*b*; bushings 42*a*, 42*b*; outer cylinders 46*a*, 46*b*; collars 48*a*, 48*b*; sealing rings 50*a*, 50*b*; drive cylinders 92*a*, 92*b*; fluid covers 120*a*, 120*b*; and fluid displacement components 144*a*, 144*b*. Drive system 14 includes housing 28; piston guide 30; piston 52; pulls 54*a*, 54*b*; and face plates 56*a*, 56*b*. Housing 28 includes guide opening 58 and defines internal pressure chamber 60. Piston guide 30 includes barrel nut 62 and guide pin 64. Piston 52 includes pull chambers 66*a*, 66*b*; central slot 68; and axial slot 70. Fluid covers 120*a*, 120*b* include, respectively, ports 72*a*, 72*b*. Fluid displacement components 144*a*, 144*b* include, respectively, plungers 80*a*, 80*b*; attachment members 82*a*, 82*b*; and drive pistons 94*a*, 94*b*. Drive pistons 94*a*, 94*b* include piston grooves 96*a*, 96*b* and piston rings 98*a*, 98*b*. Outlet manifold 18 includes elbows 19*a*, 19*b*. Inlet manifold 16 includes elbows 19*c*, 19*d*. Drive shaft 84 and cam follower 86 of drive 38 are shown.

Housing 28 defines internal pressure chamber 60. Bushings 42*a*, 42*b* are disposed within housing. Piston 52 is disposed within housing 28 and supported by bushings 42*a*, 42*b*. Cam follower 86 extends into central slot 68 of piston 52 and is configured to drive oscillation of piston 52 along piston axis A-A. Piston guide 30 extends through housing 28 and engages axial slot 70 of piston 52 to prevent piston 52 from rotating about piston axis A-A. Barrel nut 68 extends through guide opening 60, and guide pin 70 is connected to barrel nut 68. As shown, guide pin 70 rides within axial slot 76 of piston 52 to prevent piston 52 from rotating about piston axis A-A.

Piston 52 includes pull chamber 72*a* disposed within a first end of piston 52 and pull chamber 72*b* disposed within a second, opposite end of piston 52. Face plates 56*a*, 56*b* are disposed at opposite ends of piston 52 and cap pull chambers 66*a*, 66*b*. Face plates 56*a*, 56*b* are configured to retain pulls 54*a*, 54*b*, within pull chambers 66*a*, 66*b* of piston 52. Face plates 56*a*, 56*b* include fastener openings to facilitate connection with piston 52. Any desired fastener, such as a bolt, can extend through the fastener openings into piston 52 to secure face plates 56*a*, 56*b* to piston 52. Pulls 86*a*, 86*b* extend out of pull chambers 72*a*, 72*b* through openings in face plates 56*a*, 56*b*.

Drive cylinders 92*a*, 92*b* are disposed between housing 28 and fluid covers 120*a*, 120*b*. Fluid covers 120*a*, 120*b* are attached to housing 28 by fasteners (not shown) extending through fluid covers 120*a*, 120*b* into housing 28. Outer cylinders 46*a*, 46*b* are disposed between fluid covers 120*a*, 120*b* and end covers 22*a*, 22*b*. End covers 22*a*, 22*b* are attached to fluid covers 120*a*, 120*b* by fasteners (not shown) extending through end covers 22*a*, 22*b* into fluid covers 120*a*, 120*b*. Collars 48*a*, 48*b* are disposed adjacent the inner sides of end covers 22*a*, 22*b*. Collars 48*a*, 48*b* receive an outer end of outer cylinders 46*a*, 46*b*. Sealing rings 50*a*, 50*b* are disposed between collars 48*a*, 48*b* and end covers 22*a*, 22*b*. Sealing rings 50*a*, 50*b* extend around and interface with an outer edge of plungers 80*a*, 80*b*.

Fluid displacement components 144*a*, 144*b* are configured to draw process fluid into pumping chambers 90*a*, 90*b* during suction strokes and to drive process fluid downstream out of pumping chambers 90*a*, 90*b* during pumping strokes. Drive pistons 94*a*, 94*b* are disposed within drive cylinders 92*a*, 92*b*. Drive piston 94*a* defines, in part, two chambers: internal pressure chamber 60 and outer chamber 88*a*. Drive piston 94*b* similarly defines, in part, two chambers: internal pressure chamber and outer chamber 88*b*. Internal pressure chamber 60 is defined by housing 28 and drive pistons 94*a*, 94*b*. Outer chambers 88*a*, 88*b* are further defined in part by fluid covers 120*a*, 120*b*. The volume of outer chambers 88*a*, 88*b* changes inversely with a change in the volume of internal pressure chamber 60 due to the movement of the drive pistons 94*a*, 94*b*. Ports 72*a*, 72*b* extend through fluid covers 120*a*, 120*b*, respectively, to connect outer chambers 88*a*, 88*b* to the atmosphere and prevent overpressurization and/or vacuum conditions from forming in outer chambers 88*a*, 88*b*.

Piston grooves 96*a*, 96*b* extend circumferentially about drive pistons 94*a*, 94*b*. Piston rings 98*a*, 98*b* are disposed in piston grooves 96*a*, 96*b* and are configured to interface with and seal against an inner circumferential surface of drive cylinders 92*a*, 92*b*. Piston rings 98*a*, 98*b* fluidly isolate internal pressure chamber 60 from outer chambers 88*a*, 88*b*. Piston rings 98*a*, 98*b* form a dynamic seal with the inner surface of drive cylinders 92*a*, 92*b* as drive pistons 94*a*, 94*b* oscillate within drive cylinders 92*a*, 92*b* during operation.

Plungers 80*a*, 80*b* extend from drive pistons 94*a*, 94*b* and into pumping chambers 90*a*, 90*b*. Plungers 80*a*, 80*b* extend through outer cylinders 46*a*, 46*b*. Pull 54*a*, drive piston 94*a*, and plunger 80*a* are connected to move as an assembly. Similarly, pull 54*b*, drive piston 94*b*, and plunger 80*b* are connected to move as an assembly. Attachment members 82*a*, 82*b* extend through drive pistons 94*a*, 94*b* and into pulls 54*a*, 54*b* and plungers 80*a*, 80*b*. In some examples, the openings in each of pulls 54*a*, 54*b*; drive pistons 94*a*, 94*b*; and plungers 80*a*, 80*b* are threaded to engage with threaded attachment members 82*a*, 82*b*. It is understood, however, that pulls 54*a*, 54*b*; drive pistons 94*a*, 94*b*; and plungers 80*a*, 80*b* can be interconnected in any desired manner. In one example, drive pistons 94*a*, 94*b* and plungers 80*a*, 80*b* are integrally formed as a single component. As such, fluid displacement components 144*a*, 144*b* can be single-piece, dual-diameter pistons.

The operation of pump 100' is similar to the operation of pump 100 (FIGS. 2A-2B), except the working fluid acts on drive pistons 94*a*, 94*b* instead of diaphragms 74*a*, 74*b* (FIGS. 2A-2B). As piston 52 is driven rightward by cam follower 86, piston 52 pulls fluid displacement component 144*b* to the right due to the connection of pull 54*b* and fluid displacement component 144*b*. Pulling fluid displacement component 144*b* to the right retracts plunger 80*b* from fluid cavity 90*b* creating suction and drawing the process fluid into fluid cavity 90*b* through inlet valve 24*b*.

As piston 52 moves rightward, the charge pressure of the working fluid in internal pressure chamber 60 drives fluid displacement component 144*a* rightward. The rightward movement of fluid displacement component 144*a* causes plunger 80*a* to proceed into fluid cavity 90*a*, thereby decreasing the volume of fluid cavity 90*a* and driving the process fluid out of fluid cavity 90*a* through outlet check valve 26*a*.

The charge pressure acts on the inner faces of drive piston 94*a* to cause the rightward movement of fluid displacement component 144*a*. The diameter D1 of drive piston 94*a* is larger than the diameter D2 of plunger 80*a*. As such, the area of drive piston 94*a* acted on by the working fluid is larger than the area of plunger 80*a* acting on the process fluid. The force exerted on drive piston 94*a* by the working fluid is the same as the force exerted on the process fluid by plunger 80*a*, due to the rigid connection between drive piston 94*a* and plunger 80*a*. Because the forces are the same, the pressure differential between the working fluid and the process fluid is the inverse of the area differential between the inner face of drive piston 94*a* and the outer face of plunger 80*a*. Force (F) is related to surface area (A) and pressure (P) according to the following equation:

$$F=PA$$

As such, assuming that the working fluid has a charge pressure of about 100 psi, that driving piston 94*a* has a diameter of about 2 in, and that plunger 80*a* has a diameter of about 1 in. The output pressure of the process fluid generated by fluid displacement component 144*a* is thus about 400 psi. The diameters D1 and D2 can be dimensioned according to any desired ratio to provide the desired output pressure based on the set charge pressure.

After piston 52 has shifted rightward, cam follower 86 causes piston 52 to reverse direction and move leftward. Face plate 56*a* engages the flanged end of pull 54*a*, and piston 52 begins to pull fluid displacement component 144*a* through a suction stroke. Plunger 80*a* is withdrawn from pumping chamber 90*a*, creating suction in pumping chamber 90*a* and drawing the process fluid into pumping chamber 90*a* through inlet valve 24*a*.

As piston 94*a* pulls fluid displacement component 144*a* through a suction stroke, the charge pressure of the working fluid pushes fluid displacement component 144*a* through a pumping stroke. The charge pressure acts on the inner face of drive piston 94*b* to push fluid displacement component 144*b* through the pumping stroke. Plunger 80*b* is driven into pumping chamber 90*b* by drive piston 94*b*, thereby decreasing the volume in pumping chamber 90*b* and driving the process fluid downstream from pumping chamber 90*b* through outlet valve 26*b*. Fluid displacement component 144*b* provides a force multiplication similar to fluid displacement component 144*a*.

Pump 100 provides significant advantages. The working fluid in internal pressure chamber 60 acts on the inner faces of drive pistons 94*a*, 94*b* to drive fluid displacement components 144*a*, 144*b* through respective pumping strokes. Drive pistons 94*a*, 94*b* reciprocate within drive cylinders 92*a*, 92*b* and remain rigid during pumping. Because drive pistons 94*a*, 94*b* are rigid, the full area of drive pistons 94*a*, 94*b* are able to transmit the full force from the working fluid to plungers 80*a*, 80*b* across the full displacement distance of fluid displacement components 144*a*, 144*b*. Drive pistons 94*a*, 94*b* thereby provide consistent force multiplication to plungers 80*a*, 80*b* throughout the displacement of fluid displacement components 144*a*, 144*b*. The force multiplication provided by fluid displacement components 144*a*, 144*b* provides for a greater pressure output from a more compact pump 100. The more compact pump arrangement is less costly to manufacture, easier for the end user to use and store, and more energy efficient.

In addition, the reciprocation of piston 52 can be sequenced to provide pulseless downstream flow. To achieve the pulseless flow, the speed of piston 52 is set such that piston 52 begins to pull fluid displacement components 144*a*, 144*b* into suction strokes prior to that fluid displacement component 144*a*, 144*b* completing its pumping stroke. As such, at least one fluid displacement component 144*a*, 144*b* is always proceeding through a pumping stroke and providing the process fluid downstream. The process fluid is pumped out of each pumping chamber 90*a*, 90*b* and provided to outlet manifold 18 at the same pressure because each fluid displacement component 144*a*, 144*b* is driven by the same charge pressure of the working fluid.

Figure 4:
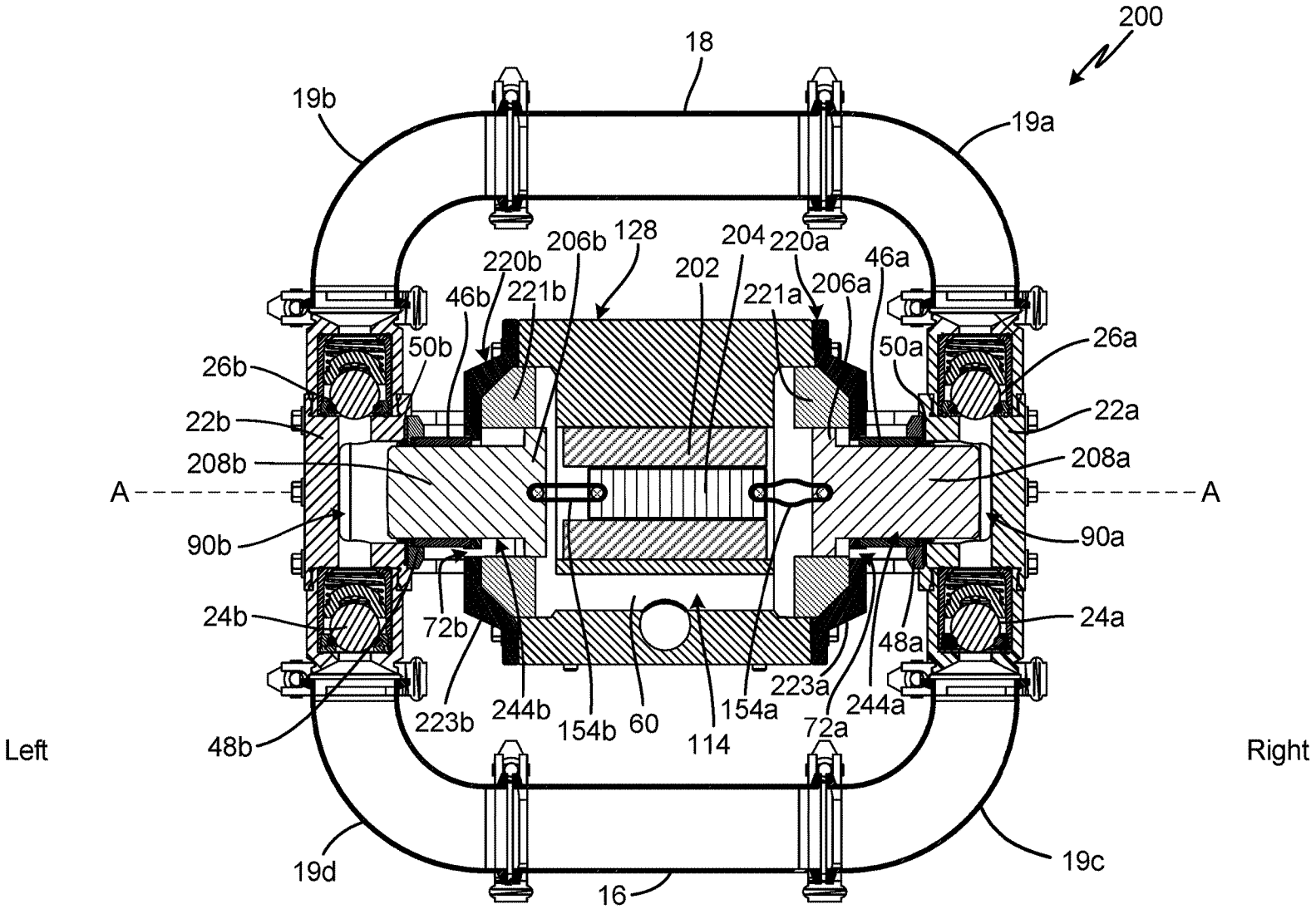
FIG. 4 is a cross-sectional view of a third pump.

FIG. 4 is a cross-sectional view of pump 200. Pump 200 includes inlet manifold 16; outlet manifold 18; end covers 22*a*, 22*b*; inlet check valves 24*a*, 24*b*; outlet check valves 26*a*, 26*b*; outer cylinders 46*a*, 46*b*; collars 48*a*, 48*b*; sealing rings 50*a*, 50*b*; fluid covers 220*a*, 220*b*; and fluid displacement components 244*a*, 244*b*. Drive system 114 includes housing 128, solenoid 202, armature 204, and pulls 154*a*, 154*b*. Housing 128 defines internal pressure chamber 60. Fluid covers 220*a*, 220*b* include, respectively, ports 72*a*, 72*b*. Fluid displacement components 244*a*, 244*b* include inner portion 206*a*, 206*b* and outer portion 208*a*, 208*b*. Outlet manifold 18 includes elbows 19*a*, 19*b*. Inlet manifold 16 includes elbows 19*c*, 19*d*.

Pump 200 is similar to pump 10 (FIGS. 2A-2B) and pump 100 (FIG. 3), except pump 200 is electrically driven. In addition, pulls 154*a*, 154*b* are bands instead of shafts having flanged and attachment ends. Housing 28 defines internal pressure chamber 60. Solenoid 202 is supported by housing 28 and is electrically connected to a power source. The power source can be external to pump 10, such motor 34 (FIG. 1) or an electric cord configured to connect to the electric grid, or internal to pump 10, such as a battery mounted in housing 28. However, with solenoid 202 supported by housing 28, drive system 14 can be considered as having the power source of drive system 14 integrated into housing 28 and internal pressure chamber 60.

Armature 204 is disposed within and configured to be driven by solenoid 202. Armature 204 is connected to fluid displacement components 44*a*, 44*b* by pulls 154*a*, 154*b*. Pulls 154*a*, 154*b* are attached to armature 204 and to inner portions 206*a*, 206*b* of fluid displacement components 244*a*, 244*b*. In the example shown, pulls 154*a*, 154*b* include flexible members, such as plastic, rubber, or elastic bands that pull in tension but do not meaningfully push in compression. Instead, in compression, pulls 154*a*, 154*b* are configured to bend so as to not transfer a compressive or pushing force to fluid displacement components 244*a*, 244*b*. Pulls 154*a*, 154*b* can be secured to armature 204 and fluid displacement components 244*a*, 244*b* in any desired manner. For example, inner portion 206*a*, 206*b* can include a groove and a cross-bore, with the end of the band forming pull 154*a*, 154*b* inserted into the groove and a set pin or cotter pin inserted into the cross-bore to retain the end of the band. In another example, pulls 154*a*, 154*b* can be integrally molded to one of fluid displacement components 244*a*, 244*b* or armature 204. Pulls 154*a*, 154*b* can also be attached to armature 204 in any desired manner, such as by pins.

While pump 10 is described as including pulls 154*a*, 154*b*, it is understood that armature 204 and fluid displacement components 244*a*, 244*b* can be connected in any desired manner. For example, armature 204 can include pull chambers, similar to pull chambers 66*a*, 66*b* (FIGS. 2B-3), extending into opposite ends of armature 204. Pulls 54*a*, 54*b* (FIGS. 2B-3) can then extend from the pull chambers and be connected to fluid displacement components 244*a*, 244*b* in any desired manner, such as by attachment members 82*a*, 82*b* (FIGS. 2B-3).

Solenoid 202 and armature 204 are of any suitable configuration for causing armature 204 to reciprocate along pump axis A-A. Solenoid 202 can be either a single-acting solenoid, such that solenoid 202 drives armature 204 in a single direction and a spring drives armature 204 in the other direction, or a double-acting solenoid, such that solenoid 202 drives armature 204 in both the left and right directions. In examples where solenoid 202 is double-acting, armature 204 can be a permanent magnet such that reversing the polarity through solenoid 202 drives the reciprocation of armature 204. In examples where solenoid 202 is single-acting, solenoid 202 can be configured to drive armature 204 in a first direction and a spring (not shown) can be configured to drive armature 204 in a second, opposite direction. For example, solenoid 202 can be configured to pull armature 204 leftward, causing armature 204 to pull fluid displacement component 44*a* through a suction stroke. The spring can be configured to push armature 204 rightward, causing armature 204 to pull fluid displacement component 44*b* through a suction stroke. It is understood that solenoid 202 can pull armature 204 rightward and the spring can push armature leftward.

Outer portions 208*a*, 208*b* and inner portions 206*a*, 206*b* of fluid displacement components 244*a*, 244*b* are integrally formed. Outer portions 208*a*, 208*b* extends from inner portions 206*a*, 206*b* through outer cylinder 46*a*, 46*b* and into fluid cavity 90*a*, 90*b*. Inner portion 206*a*, 206*b* is surrounded by a bore within fluid cover 220*a*, 220*b*. Is some examples, fluid covers 220*a*, 220*b* are formed from multiple components, such as inner cover portions 221*a*, 221*b* and outer cover portions 223*a*, 223*b*. In other examples, fluid covers 220*a*, 220*b* can be formed from a single part. For example, each fluid cover 220*a*, 220*b* can include outer cover portion 223*a*, 223*b* that is bolted to the central portion of housing 128, and inner cover portions 221*a*, 221*b* that define the bore within which inner portions 206*a*, 206*b* of fluid displacement components 244*a*, 244*b* reciprocate. Outer cover portions 223*a*, 223*b* and inner cover portions 221*a*, 221*b* can be formed of different materials. For example, outer cover portions 223*a*, 223*b* can be metallic, and inner cover portions 221*a*, 221*b* can be formed from a material suitable for sealing directly or indirectly with inner portions 206*a*, 206*b*. In one example, inner cover portions

221*a*, 221*b* of each fluid cover 220*a*, 220*b* can be formed from an elastomer. In another example, inner portions 206*a*, 206*b* can each include a circumferential groove and a seal (similar to grooves 96*a*, 96*b* and rings 98*a*, 98*b* shown in FIG. 3), and the seal can seal against inner cover portions 221*a*, 221*b* of each fluid cover 220*a*, 220*b*.

Inner portion 206*a* defines, in part, two chambers: internal pressure chamber 60 and outer chamber 88*a*. Inner portion 206*b* defines, in part, two chambers: internal pressure chamber 60 and outer chamber 88*b*. Internal pressure chamber 60 is defined by housing 28 and inner portions 206*a*, 206*b*. Outer chambers 88*a*, 88*b* are further defined in part by fluid covers 220*a*, 220*b*. Inner portions 206*a*, 206*b* seal against the bores in fluid covers 220*a*, 220*b* to prevent the working fluid from leaking out of internal pressure chamber 60 into outer chambers 88*a*, 88*b*. Ports 72*a*, 72*b* provide vent path between outer chambers 88*a*, 88*b* and the atmosphere.

The operation of pump 200 is similar to the operation of pump 10 (FIGS. 2A-2B) and pump 100 (FIG. 3), except the working fluid acts on fluid displacement components 244*a*, 244*b* and reciprocation is caused by solenoid 202 and armature 204. A charge is provided to solenoid 202 to cause displacement of armature 204 along pump axis A-A. As armature 204 moves rightward, armature 204 pulls fluid displacement component 244*b* to the right due to pull 154*b* connecting armature 204 and fluid displacement component 244*b*. Pulling fluid displacement component 44*b* retracts outer portion 208*b* from pumping cavity 90*b*, creating suction and drawing the process fluid into pumping cavity 90*b* through inlet valve 24*b*.

As armature 204 moves rightward, the charge pressure of the working fluid in internal pressure chamber 60 drives fluid displacement component 244*a* rightward. The rightward movement of fluid displacement component 244*a* causes outer portion 208*a* to move into pumping cavity 90*a*, thereby decreasing the volume of pumping cavity 90*a* and driving the process fluid out of pumping cavity 90*a* through outlet check valve 26*a*. The working fluid acts on inner portion 206*a* to drive fluid displacement component 244*a*. In the example shown, inner portion 206*a* has a larger diameter than outer portion 208*a*, and as such fluid displacement component 244*a* provides a force multiplication between the charge pressure of the working fluid and the output pressure of the process fluid.

After armature 204 has shifted rightward, armature 204 reverses direction and moves leftward. As discussed above, the leftward movement can be caused by a spring when the charge is removed from solenoid 202, by a reversal of the polarity of the charge to solenoid 202, or by any other suitable mechanism or method. Pull 154*a* connects armature 204 and fluid displacement component 44*a*, and pull 154*a* pulls fluid displacement component 44*a* through a suction stroke. Outer portion 208*a* is withdrawn from pumping chamber 90*a*, creating suction in pumping chamber 90*a* and drawing the process fluid into pumping chamber 90*a* through inlet valve 24*a*.

As armature 204*a* pulls fluid displacement component 44*a* through a suction stroke, the charge pressure of the working fluid pushes fluid displacement component 44*b* through a pumping stroke. The charge pressure acts on inner portion 206*b* to push fluid displacement component 44*b* through the pumping stroke. Outer portion 208*b* is driven into pumping chamber 90*b* by inner portion 206*b*, thereby decreasing the volume in pumping chamber 90*b* and driving the process fluid downstream from pumping chamber 90*b* through outlet valve 26*b*. Fluid displacement component 244*b* provides a force multiplication similar to fluid displacement component 244*a*.

Pump 200 provides significant advantages. The electric driving components, solenoid 202 and armature 204, are disposed within housing 28 and internal pressure chamber 60, which provides for a compact, self-contained pump. Fluid displacement components 244*a*, 244*b* provide force multiplication between the charge pressure within internal pressure chamber 60 and the output pressure of the process fluid due to the differing diameters of inner portions 206*a*, 206*b* and outer portions 208*a*, 208*b*. Armature 204 pulls fluid displacement components 244*a*, 244*b* through suction strokes but is prevented from pushing fluid displacement components 244*a*, 244*b* through pumping strokes by pulls 154*a*, 154*b*. Instead, the working fluid pushes fluid displacement components 244*a*, 244*b* through the pumping strokes. As such, the strokes of fluid displacement components 244*a*, 244*b* can be sequenced to eliminate downstream pulsation. In addition, pump 10 can be deadheaded without damaging any components, as pulls 154*a*, 154*b* do not transfer compressive, pumping forces to fluid displacement components 244*a*, 244*b*.

As shown, different drive mechanisms, reciprocating members, pulls, and fluid displacement components are possible, and embodiments consistent with this disclosure are not limited to the particular embodiments or options disclosed herein. While electrically driven motors and pistons have been disclosed herein, an air or hydraulically driven piston or other reciprocating member could be used instead of or in combination with any fluid displacement component of any embodiment herein.

Figure 5:
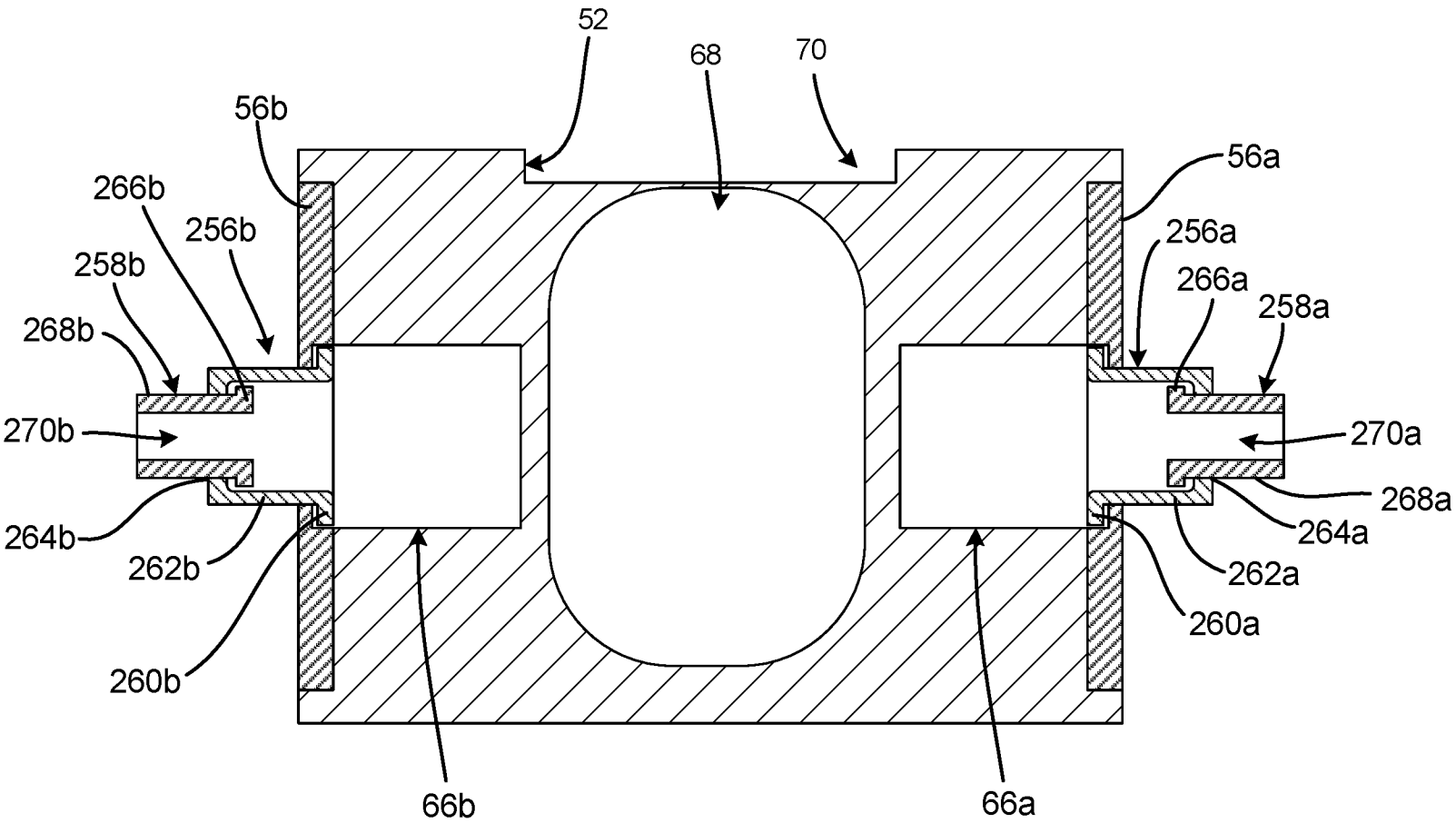
FIG. 5 is a cross-sectional view of a piston and pulls.

FIG. 5 is a cross-sectional view of piston 52 and pulls 254*a*, 254*b*. Piston 52 includes face plates 56*a*, 56*b*; pull chambers 66*a*, 66*b*; central slot 68; and axial slot 70. Pulls 254*a*, 254*b* include inner sections 256*a*, 256*b* and outer sections 258*a*, 258*b*. Inner sections 256*a*, 256*b* include first outer flanges 260*a*, 260*b*; first shafts 262*a*, 262*b*; and first inner flanges 264*a*, 264*b*. Outer sections 258*a*, 258*b* include second outer flanges 266*a*, 266*b*; second shafts 268*a*, 268*b*; and attachment bores 270*a*, 270*b*.

Piston 52 is configured to reciprocate within a housing, such as housing 28 (FIGS. 1-3), to pull fluid displacement components, such as fluid displacement components 44*a*, 44*b* (FIGS. 2A-2B), fluid displacement components 144*a*, 144*b* (FIG. 3), and fluid displacement components 244*a*, 244*b* (FIG. 4), through suction strokes. Face plates 56*a*, 56*b* are attached to opposite ends of piston 52 and enclose pull chambers 66*a*, 66*b*. Pulls 54*a*, 54*b* are configured to transmit tensile forces but not compressive forces, such that piston 52 can pull the fluid displacement components via pulls 254*a*, 254*b*, but cannot push the fluid displacement components via pulls 254*a*, 254*b*.

Inner sections 256*a*, 256*b* are at least partially retained within pull chambers 66*a*, 66*b* by face plates 56*a*, 56*b*. First outer flanges 260*a*, 260*b* project from first shafts 262*a*, 262*b* and are disposed within pull chambers 66*a*, 66*b*. First shafts 262*a*, 262*b* extend through openings in face plates 56*a*, 56*b* and are configured to slide within the openings in face plates 56*a*, 56*b*. First outer flanges 260*a*, 260*b* are wider than the openings through face plates 56*a*, 56*b* such that first outer flanges 260*a*, 260*b* cannot pass through the openings. Instead, first outer flanges 260*a*, 260*b* engage the inner sides of face plates 56*a*, 56*b*.

First inner flanges 264*a*, 264*b* of inner sections 256*a*, 256*b* project into a bore through the end of inner sections 256*a*, 256*b* disposed opposite first outer flanges 260*a*, 260*b*.

Outer sections 258*a*, 258*b* are configured to slide within inner sections 256*a*, 256*b*. Second shafts 268*a*, 268*b* extend through the bore defined by first inner flanges 264*a*, 264*b*. Second outer flanges 266*a*, 266*b* are configured to engage first inner flanges 264*a*, 264*b* to prevent outer sections 258*a*, 258*b* from sliding out of inner sections 256*a*, 256*b*. Attachment bores 270*a*, 270*b* are configured to receive attachment members 82 (FIGS. 2A-3) to connect pulls 54*a*, 54*b* to the fluid displacement members.

During operation, outer members 258*a*, 258*b* are configured to house within inner members 256*a*, 256*b*, and inner members 256*a*, 256*b* are configured to house within pull chambers 66*a*, 66*b* to prevent piston 52 from pushing the fluid displacement members. As such, pulls 54*a*, 54*b* are configured to telescope during operation. While pulls 54*a*, 54*b* are each shown as including two members that are slidable, it is understood that pulls 54*a*, 54*b* can include as many or as few slidable members as desired. Pulls 54*a*, 54*b* including multiple slidable members configured to telescope reduces the depth required for pull chambers 66*a*, 66*b* to house pulls 54*a*, 54*b*. The more compact pull chambers 66*a*, 66*b* reduces the footprint of the pump and provides for a more compact pump.

Figure 6:
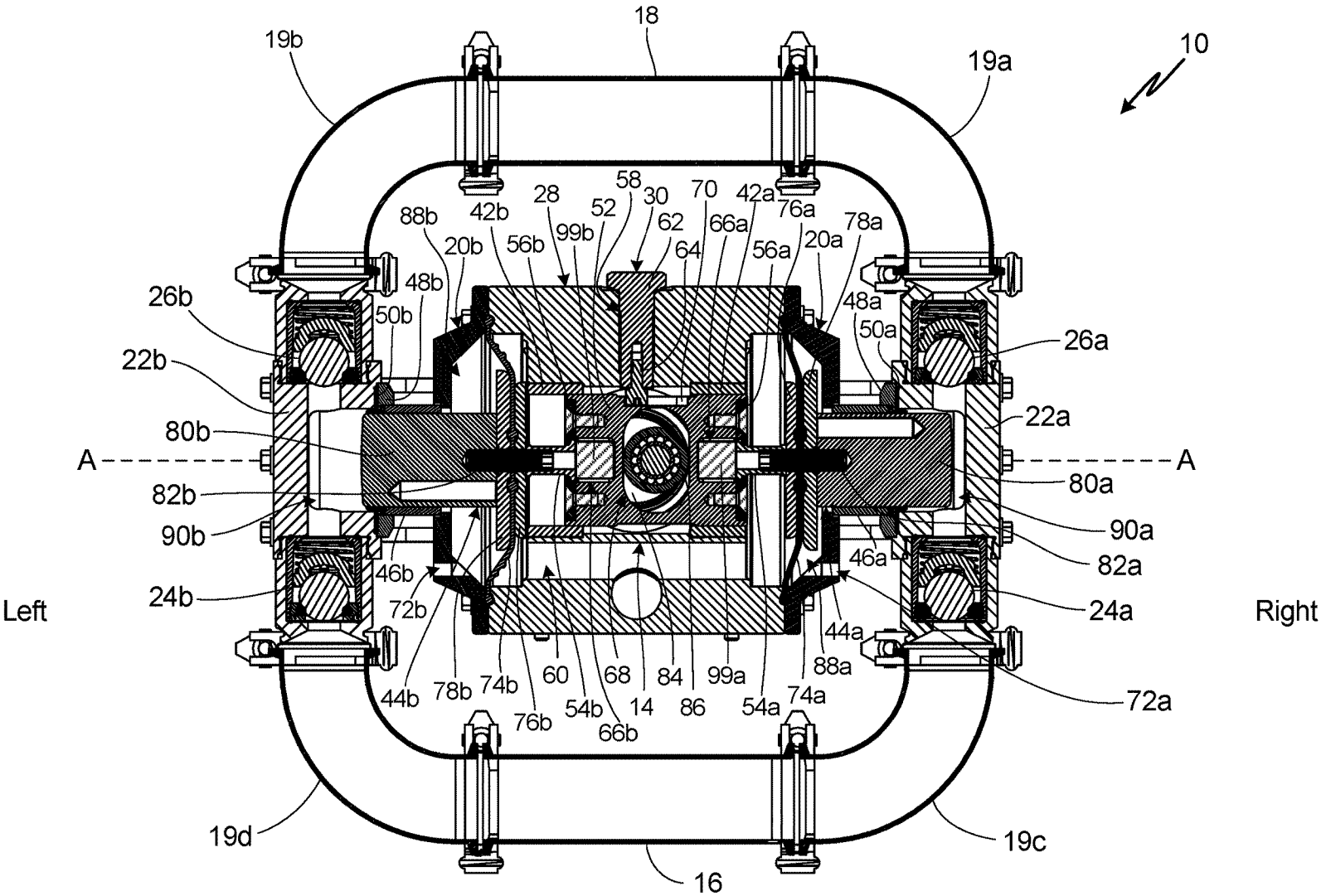
FIG. 6 is a cross-sectional view taken along line 2-2 in FIG. 1.

FIG. 6 is a cross-sectional view of pump 10. Pump 10 includes inlet manifold 16; outlet manifold 18; fluid covers 20*a*, 20*b*; end covers 22*a*, 22*b*; inlet check valves 24*a*, 24*b*; outlet check valves 26*a*, 26*b*; bushings 42*a*, 42*b*; fluid displacement components 44*a*, 44*b*; outer cylinders 46*a*, 36*b*; collars 48*a*, 48*b*; and sealing rings 50*a*, 50*b*. Drive system 14 includes housing 28; piston guide 30; piston 52; pulls 54*a*, 54*b*; face plates 56*a*, 56*b*, and plugs 99*a*, 99*b*. Housing 28 includes working fluid inlet 32 and guide opening 58. Housing 28 defines internal pressure chamber 60. Piston guide 30 includes barrel nut 62 and guide pin 64. Piston 52 includes pull chambers 66*a*, 66*b*; central slot 68; and axial slot 70. Fluid covers 20*a*, 20*b* include, respectively, ports 72*a*, 72*b*. Fluid displacement components 44*a*, 44*b* include, respectively, diaphragms 74*a*, 74*b*; plungers 80*a*, 80*b*; attachment members 82*a*, 82*b*. Outlet manifold 18 includes elbows 19*a*, 19*b*. Inlet manifold 16 includes elbows 19*c*, 19*d*. Drive shaft 84 and cam follower 86 of drive 38 are shown.

Pump 10 shown in FIG. 6 is the same as pump 10 shown in FIG. 2B, except pump 10 shown in FIG. 6 includes plugs 99*a*, 99*b*. Plugs 99*a*, 99*b* are disposed in pull chambers 66*a*, 66*b* and are configured to prevent pulls 54*a*, 54*b* from sliding within pull chambers 66*a*, 66*b*. Instead, plugs 99*a*, 99*b* allow piston 52 to transmit compressive, pushing forces to fluid displacement components 44*a*, 44*b* such that piston 52 can drive fluid displacement components 44*a*, 44*b* through pumping strokes in addition to suction strokes. As such, plugs 99*a*, 99*b* enable pump 10 to be easily converted between mechanical/fluid operating mode and a mechanical/mechanical operating mode. In the mechanical/fluid operating mode fluid displacement components 44*a*, 44*b* are mechanically pulled through their respective suction strokes and are driven through respective pumping strokes by the charge pressure of the working fluid disposed in internal pressure chamber 60. In the mechanical/mechanical operating mode, fluid displacement components 44*a*, 44*b* are mechanically pulled through their respective suction strokes and are also mechanically driven through their respective pumping strokes. When operating in the mechanical/mechanical operating mode, internal pressure chamber 60 does not require a charge of working fluid, as piston 52 drives fluid displacement components 44*a*, 44*b* through the pumping strokes.

To convert pump 10 to the mechanical/mechanical operating mode, the user removes face plates 56*a*, 56*b* and pulls 54*a*, 54*b*, from piston 52 and drops plugs 99*a*, 99*b* into pull chambers 66*a*, 66*b*. Face plates 56*a*, 56*b* and pulls 54*a*, 54*b* can then be reinstalled on piston 52.

In some examples, pump 10 includes a pressure switch (not shown) connected to drive system 14. The pressure switch can be configured to switch off drive system 14 based on a sensed pressure reaching or exceeding a threshold. For example, pressure switch can be configured to sense the pressure in pumping chambers 90*a*, 90*b* and/or in outlet manifold 18. In the event pump 10 is deadheaded, the pressure will spike in either pumping chambers 90*a*, 90*b* and/or outlet manifold 18 as drive 38 causes reciprocation of piston 52. The spike in pressure will trip the pressure switch, causing the pressure switch to deactivate drive 38 while pump 10 is deadheaded. In some examples, the user can reactivate pump 10 after downstream flow is returned. In other examples, the pressure switch can be configured to sense the drop in the process fluid pressure, indicating that downstream flow has returned, and can reactivate pump 10 based on that drop in process fluid pressure.

Pump 10 provides significant advantages. Pump 10 is convertible between the mechanical/fluid operating mode and the mechanical/mechanical operating mode, thereby providing a wide range of pumping options to the end user. The end user can operate in the mechanical/mechanical mode when high downstream pressures are desired or working fluid is unavailable. The end user can operate in the mechanical/fluid operating mode to eliminate downstream pulsation and allow pump 10 to continue operating when deadheaded.

Figure 7:
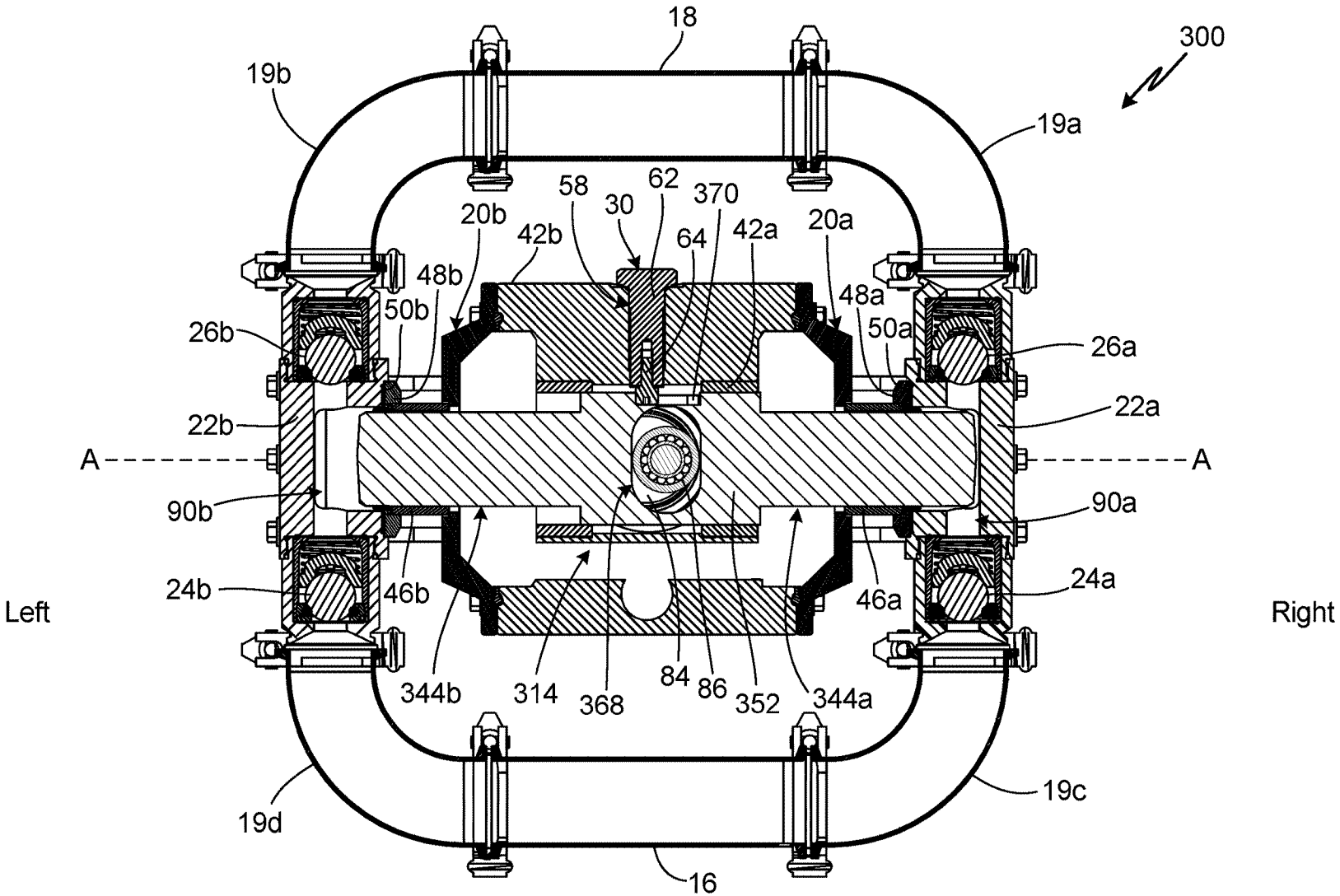
FIG. 7 is a cross-sectional view of a fourth pump.

FIG. 7 is a cross-sectional view of pump 300. Pump 300 includes inlet manifold 16; outlet manifold 18; fluid covers 20*a*, 20*b*; end covers 22*a*, 22*b*; inlet check valves 24*a*, 24*b*; outlet check valves 26*a*, 26*b*; bushings 42*a*, 42*b*; outer cylinders 46*a*, 46*b*; collars 48*a*, 48*b*; sealing rings 50*a*, 50*b*; fluid displacement components 344*a*, 344*b*. Drive system 314 includes housing 28, piston guide 30, and piston 352. Housing 28 includes guide opening 58. Piston guide 30 includes barrel nut 62 and guide pin 64. Piston 352 includes central slot 368 and axial slot 370. Outlet manifold 18 includes elbows 19*a*, 19*b*. Inlet manifold 16 includes elbows 19*c*, 19*d*. Drive shaft 84 and cam follower 86 of drive 38 are shown.

Housing 28 is disposed between fluid covers 20*a*, 20*b*. Outer cylinders 46*a*, 46*b* are disposed between fluid covers 20*a*, 20*b* and end covers 22*a*, 22*b*. Inlet manifold 16 is configured to provide process fluid to pumping chambers 90*a*, 90*b* within end covers 22*a*, 22*b*. Inlet check valves 24*a*, 24*b* are disposed between inlet manifold 16 and end covers 22*a*, 22*b*. Outlet manifold 18 is configured to receive process fluid from pumping chambers 90*a*, 90*b*. Outlet check valves 26*a*, 26*b* are disposed between end covers 22*a*, 22*b* and outlet manifold 18.

Bushings 42*a*, 42*b* are disposed within housing 28 and configured to support piston 352. Piston 352 is disposed within bushings 42*a*, 42*b* and is configured to reciprocate along pump axis A-A. Piston guide 30 prevent piston 352 from rotating about pump axis A-A. Barrel nut 62 is disposed in guide opening 58, and guide pin 64 is connected to barrel nut 62 and extends into and engages axial slot 370. Fluid displacement component 344*a* extends from a first side of piston 352, through outer cylinder 46*a*, and into pumping chamber 90*a* within end cover 22*a*. Fluid displacement component 344*b* extends from a second side of piston 352, through outer cylinder 46*b*, and into pumping chamber

90*b* within end cover 22*b*. As shown, fluid displacement components 344*a*, 344*b* are integrally formed with piston 352. It is understood, however, that fluid displacement components 344*a*, 344*b* can be formed separately from piston 352 and joined with piston 352 in any desired manner, such as by a fastener similar to attachment members 82*a*, 82*b* (FIGS. 2A-3).

Fluid displacement components 344*a*, 344*b* and piston 352 are configured to reciprocate as a single assembly. Piston 352 is configured to drive fluid displacement components 344*a*, 344*b* through both their respective suctions strokes and pumping strokes. During a suction stroke, piston 352 retracts fluid displacement component 344*a*, 344*b* from fluid cavity 90*a*, 90*b* to increase a volume of fluid cavity 90*a*, 90*b*, creating suction in fluid cavity 90*a*, 90*b* and drawing process fluid into fluid cavity 90*a*, 90*b* through inlet valve 24*a*, 24*b*. During a pumping stroke, piston 352 drives fluid displacement component 344*a*, 344*b* into fluid cavity 90*a*, 90*b* to decrease a volume of fluid cavity 90*a*, 90*b* and drive the process fluid out of fluid cavity 90*a*, 90*b* through outlet valve 26*a*, 26*b*.

While pump 300 is shown as including fluid displacement components 344*a*, 344*b*, it is understood that pump 300 can include any fluid displacement member suitable for displacing the fluid within pumping chambers 90*a*, 90*b*. In one example, pump 300 can include fluid displacement components 44*a*, 44*b* (best seen in FIG. 2B), with diaphragms 74*a*, 74*b* (best seen in FIG. 2B) rigidly connected to piston 352 such that piston 352 drives fluid displacement components 44*a*, 44*b* through both suction and pumping strokes. In other examples, pump 300 can include fluid displacement components 144*a*, 144*b* (FIG. 3) or fluid displacement components 244*a*, 244*b* (FIG. 4) rigidly connected to piston 352 such that piston 352 drives fluid displacement components 144*a*, 144*b* or fluid displacement components 244*a*, 244*b* through both suction and pumping strokes.

Pump 300 provides significant advantages. Drive system 314 mechanically drives fluid displacement components 344*a*, 344*b* through both suction and pumping strokes. Mechanically driving fluid displacement components 344*a*, 344*b* provides increased efficiency by eliminating working fluids. As such, pump 300 can be utilized at locations where compressed air and/or hydraulic fluid is not readily available. In addition, fluid displacement components 344*a*, 344*b* being configured as pistons allows pump 300 to generate higher pumping pressures as compared to mechanically-driven diaphragms.

Figure 8:
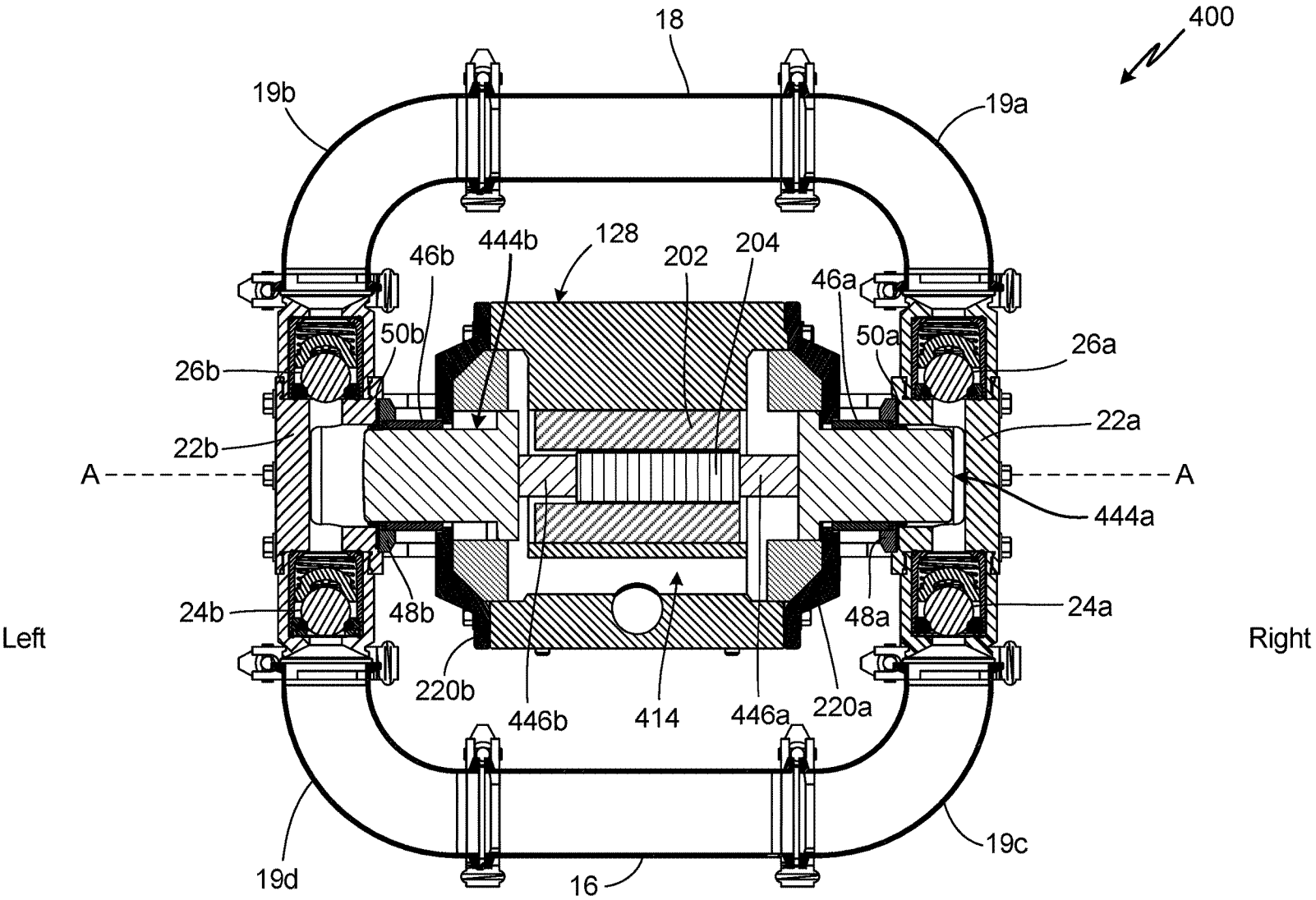
FIG. 8 is a cross-sectional view of a fifth pump.

FIG. 8 is a cross-sectional view of pump 400. Pump 400 includes inlet manifold 16; outlet manifold 18; end covers 22*a*, 22*b*; inlet check valves 24*a*, 24*b*; outlet check valves 26*a*, 26*b*; outer cylinders 46*a*, 46*b*; collars 48*a*, 48*b*; sealing rings 50*a*, 50*b*; fluid covers 220*a*, 220*b*; and fluid displacement components 444*a*, 444*b*. Drive system 414 includes housing 128, solenoid 202, armature 204, and intermediate members 446*a*, 446*b*. Outlet manifold 18 includes elbows 19*a*, 19*b*. Inlet manifold 16 includes elbows 19*c*, 19*d*.

Pump 400 shown in FIG. 8 is substantially similar to pump 200 shown in FIG. 4, except pump 400 shown in FIG. 8 includes armature 204 that is rigidly connected to fluid displacement components 444*a*, 444*b* by intermediate members 446*a*, 446*b*. Fluid displacement components 444*a*, 444*b* are substantially similar to fluid displacement components 244*a*, 244*b*. Armature 204 is rigidly connected to fluid displacement components 444*a*, 444*b* such that armature 204 drives fluid displacement components 444*a*, 444*b* through both the suction and pumping strokes. Intermediate members 446*a*, 446*b* can be any desired component capable of transmitting forces both in tension and in compression. For example, intermediate members 446*a*, 446*b* can be threaded members configured to engage with threaded bores on both armature 204 and fluid displacement components 444*a*, 444*b*. In other examples, intermediate members 446*a*, 446*b* can be pinned to armature 204 and fluid dispensing components 444*a*, 444*b*; can be formed integrally with one or both of fluid dispensing components 444*a*, 444*b* and armature 204; or can provide a rigid connection in any other manner suitable for transmitting both compressive and tensile forces between armature 204 and fluid displacement components 444*a*, 444*b*.

Solenoid 202 is configured to drive armature 204 along pump axis A-A to cause armature 204 to drive fluid displacement components 444*a*, 444*b* through the suction and pumping strokes. The current supplied to solenoid 202 is configured to prevent overpressurization in the event that pump 400 is deadheaded during operation. The current is sufficient to drive armature 204. However, when pumping chambers 90*a*, 90*b* are pressurized during the deadhead event, the process fluid pressure acts on fluid displacement components 444*a*, 444*b* and resists movement of armature 204 and overcomes the driving force provided by solenoid 202. As such, the output pressure capable of being produced by pump 400 is dependent on the current powering solenoid 202 and the surface area of fluid displacement component 444*a*, 444*b* impacting the process fluid.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump for pumping a process fluid, the pump comprising:

a housing defining an internal pressure chamber, the internal pressure chamber configured to contain a working fluid;

an end cover spaced from a first end of the housing and at least partially defining a process fluid flowpath;

a fluid cover connected to the first end of the housing;

a spacer disposed between the fluid cover and the end cover, wherein the spacer has a cylindrical interior and is connected to the end cover;

a reciprocating member disposed within the internal pressure chamber;

a fluid displacement component having a first portion having a first surface and a second portion having a second surface, the first surface configured to contact the working fluid and the second surface configured to contact the process fluid in the process fluid flowpath, wherein the fluid displacement component is configured such that pressure exerted on the first surface by the working fluid moves the second surface in a first direction towards the process fluid to expel the process fluid downstream, and wherein an area of the first surface is greater than an area of the second surface;

a pull extending between the reciprocating member and the fluid displacement component, the pull mechanically transferring a pulling force from the reciprocating member to the fluid displacement component to move the fluid displacement component in a second direction that is the opposite of the first direction, wherein the pull does not mechanically transfer a pushing force from the reciprocating member to the fluid displacement component when the reciprocating member moves in the first direction; and an outer chamber formed on a side of the first portion opposite the first surface and between the first portion and the fluid cover, wherein the first portion fluidly isolates the outer chamber from the internal pressure chamber, the second portion fluidly isolates the outer chamber from the process fluid flowpath, and at least one vent hole is formed to allow air to enter into the outer chamber and exit from the outer chamber to prevent over pressurization of the outer chamber;

wherein the fluid displacement component extends though the spacer and is configured to reciprocate within the cylindrical interior of the spacer; and wherein a circumferential edge of the first portion seals within the housing such that the first portion at least partially defines the internal pressure chamber and a circumferential edge of the second portion seals within the cylindrical interior of the spacer such that the second portion at least partially defines the process fluid flowpath.

2. The pump of claim 1, wherein the reciprocating member is a piston.

3. The pump of claim 1, further comprising:

an electric motor; and a drive system connecting the electric motor and the reciprocating member;

wherein the electric motor reciprocates the reciprocating member via the drive system.

4. The pump of claim 1, wherein the fluid displacement component comprises a diaphragm forming the first portion and that defines the first surface.

5. The pump of claim 4, wherein the fluid displacement component further comprises a plunger forming the second portion and attached to the diaphragm, the plunger defining the second surface.

6. The pump of claim 5, wherein a circumferential edge of the diaphragm is retained between the first end of the housing and the fluid cover, and wherein the circumferential edge of the diaphragm is the circumferential edge of the first portion;

wherein the plunger extends through the fluid cover and into the end cover.

7. The pump of claim 6, wherein:

the spacer is mounted on the fluid cover and the end cover; and the plunger extends through the cylindrical interior of the spacer and is configured to reciprocate within the cylindrical interior.

8. The pump of claim 1, wherein:

the reciprocating member includes a pull chamber;

the pull includes a pull shaft extending out of the pull chamber and connected to the fluid displacement component, and a flange disposed at a first end of the pull shaft within the pull chamber; and the flange retains the first end of the pull shaft within the pull chamber.

9. The pump of claim 1, wherein the pull is a flexible member configured to transfer tensile forces but bend in response to compressive forces.

10. The pump of claim 1, further comprising:

a solenoid disposed within housing;

wherein the reciprocating member comprises an armature disposed within the solenoid; and wherein the solenoid is a double-acting solenoid.

11. The pump of claim 1, wherein the first portion of the fluid displacement component comprises a piston defining the first surface.

12. The pump of claim 11, wherein the second portion of the fluid displacement component further comprises a plunger connected to and extending from the piston, wherein the plunger defines the second surface.

13. The pump of claim 12, wherein the piston has a first diameter and the second piston plunger has a second diameter, the first diameter being larger than the second diameter.

14. The pump of claim 13, further comprising:

a first cylinder extending between the fluid cover and the housing, wherein the piston is disposed within the first cylinder; and wherein the spacer extends between the end cover and the fluid cover, wherein the plunger is disposed within the cylindrical interior of the spacer.

15. A pump for pumping a process fluid, the pump comprising:

a housing defining an internal pressure chamber, the internal pressure chamber configured to contain a working fluid;

a reciprocating member configured to reciprocate on an axis;

a fluid displacement component having a first member defining a first surface and a second member defining a second surface, the first surface configured to contact the working fluid and the second surface configured to contact the process fluid, wherein the fluid displacement component is configured such that pressure exerted on the first surface by the working fluid moves the second surface in a first axial direction to expel the process fluid, and wherein an area of the first surface is greater than an area of the second surface; and a pull that links the reciprocating member to the fluid displacement component, the pull mechanically transferring a pulling force from the reciprocating member to the fluid displacement component to move the fluid displacement component in a second direction; and an attachment member extending from the second member, through the first member, and into the pull to connect the second member to the pull;

wherein a first seal is formed between a circumferential edge of the first member and the housing to at least partially define the internal pressure chamber;

wherein the first member is disposed axially between the reciprocating member and the second member; and wherein the first member is isolated from the process fluid such that the first member does not contact the process fluid.

16. The pump of claim 15, wherein:

the first member comprises a diaphragm that is configured to be moved by the working fluid, wherein the diaphragm defines the first surface;

the second member comprises a plunger that is attached to the diaphragm to move with the diaphragm as the diaphragm is moved by the working fluid, wherein the plunger defines the second surface and movement of the plunger drives the process fluid.

* * * * *